US007817943B2

(12) United States Patent
Utsumi et al.

(10) Patent No.: US 7,817,943 B2
(45) Date of Patent: Oct. 19, 2010

(54) DEVELOPER TRANSPORT APPARATUS AND IMAGE FORMING APPARATUS

(75) Inventors: Shinichi Utsumi, Kanagawa (JP); Takehiro Ishii, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 412 days.

(21) Appl. No.: 11/783,489

(22) Filed: Apr. 10, 2007

(65) Prior Publication Data

US 2008/0056772 A1 Mar. 6, 2008

(30) Foreign Application Priority Data

Aug. 29, 2006 (JP) ..... P.2006-231435

(51) Int. Cl.
*G03G 15/08* (2006.01)

(52) U.S. Cl. ..... 399/254; 399/258; 399/263

(58) Field of Classification Search ..... 399/58, 399/61, 30, 260, 263, 254
See application file for complete search history.

(56) References Cited

U.S. PATENT DOCUMENTS

| | | | | | |
|---|---|---|---|---|---|
| 4,739,907 | A * | 4/1988 | Gallant | 222/240 |
| 5,264,900 | A * | 11/1993 | Momiyama et al. | 399/256 |
| 5,331,381 | A * | 7/1994 | Ota et al. | 399/258 |
| 5,355,199 | A * | 10/1994 | Bray | 399/256 |
| 5,629,758 | A * | 5/1997 | Kageyama et al. | 399/263 |
| 6,795,660 | B2 | 9/2004 | Yugeta et al. | 399/27 |
| 2003/0142998 | A1 * | 7/2003 | Tanaka | 399/258 |
| 2004/0028426 | A1 * | 2/2004 | Sugihara | 399/254 |
| 2005/0013633 | A1 * | 1/2005 | Harumoto | 399/258 |
| 2005/0053387 | A1 * | 3/2005 | Itoh | 399/27 |
| 2005/0207797 | A1 * | 9/2005 | Fujita et al. | 399/258 |

FOREIGN PATENT DOCUMENTS

| | | |
|---|---|---|
| CN | 1484110 | 3/2004 |
| JP | 61-200841 | 9/1986 |
| JP | 8-44173 | 2/1996 |
| JP | 10-161408 | 6/1998 |
| JP | 2000-081787 | 3/2000 |

* cited by examiner

*Primary Examiner*—David M Gray
*Assistant Examiner*—Roy Yi
(74) *Attorney, Agent, or Firm*—Morgan, Lewis & Bockius LLP

(57) ABSTRACT

A developer transport apparatus includes: a first developer-containing unit that contains a developer; a first developer transport member disposed in the first developer-containing unit, the first developer transport member transporting the developer in a first direction; a second developer transport member disposed downstream from the first developer transport member in the first direction, the second developer transport member transporting the developer in the first direction and having a lower capability of transporting the developer than that of the first developer transport member; a developer discharge unit disposed in the first developer-containing unit, the developer discharge unit discharging the developer transported by the second developer transport member from the first developer-containing unit; and a second developer-containing unit that contains the developer discharged from the developer discharge unit.

12 Claims, 18 Drawing Sheets

FIG. 16

TABLE 1. EFFECT CONFIRMATION RESULT
(AVERAGE TRANSPORT RATE 0.4g/s)

| STRUCTURE | TONER TRANSPORT RATE STANDARD DEVIATION (g/s) |
|---|---|
| (COMPARATIVE EXAMPLE) WITHOUT PENETRATION SHAFT | 0.4-0.5 |
| (EXAMPLE 1) WITH PENETRATION SHAFT (WITH SCREW AUGER) | 0.1-0.2 |

DEVELOPER TRANSPORT APPARATUS AND IMAGE FORMING APPARATUS

CROSS-REFERENCE TO RELATED APPLICATION

This application is based on and claims priority under 35 USC §119 from Japanese Patent Application No. 2006-231435 filed Aug. 29, 2006.

BACKGROUND (i) Technical Field

This invention relates to a developer transport apparatus and an image forming apparatus having the developer transport apparatus.

(ii) Related Art

Image forming apparatuses such as a copier and a printer employing the electrophotography method have heretofore been provided with a developer transport apparatus transporting a developer such as a refill developer, a collected waste developer, and paper dust.

Various developer transport apparatuses disposed in image forming apparatuses have been proposed.

SUMMARY

According to one aspect of the present invention, there is provided a developer transport apparatus comprising:

a first developer-containing unit that contains a developer;

a first developer transport member disposed in the first developer-containing unit, the first developer transport member transporting the developer in a first direction;

a second developer transport member disposed downstream from the first developer transport member in the first direction, the second developer transport member transporting the developer in the first direction and having a lower capability of transporting the developer than that of the first developer transport member;

a developer discharge unit disposed in the first developer-containing unit, the developer discharge unit discharging the developer transported by the second developer transport member from the first developer-containing unit; and a second developer-containing unit that contains the developer discharged from the developer discharge unit.

BRIEF DESCRIPTION OF THE DRAWINGS

Embodiments of the present invention will be described in detail based on the following figures, wherein:

FIG. 16 is a table showing experimental results of the embodiment 1;

Figure 1:
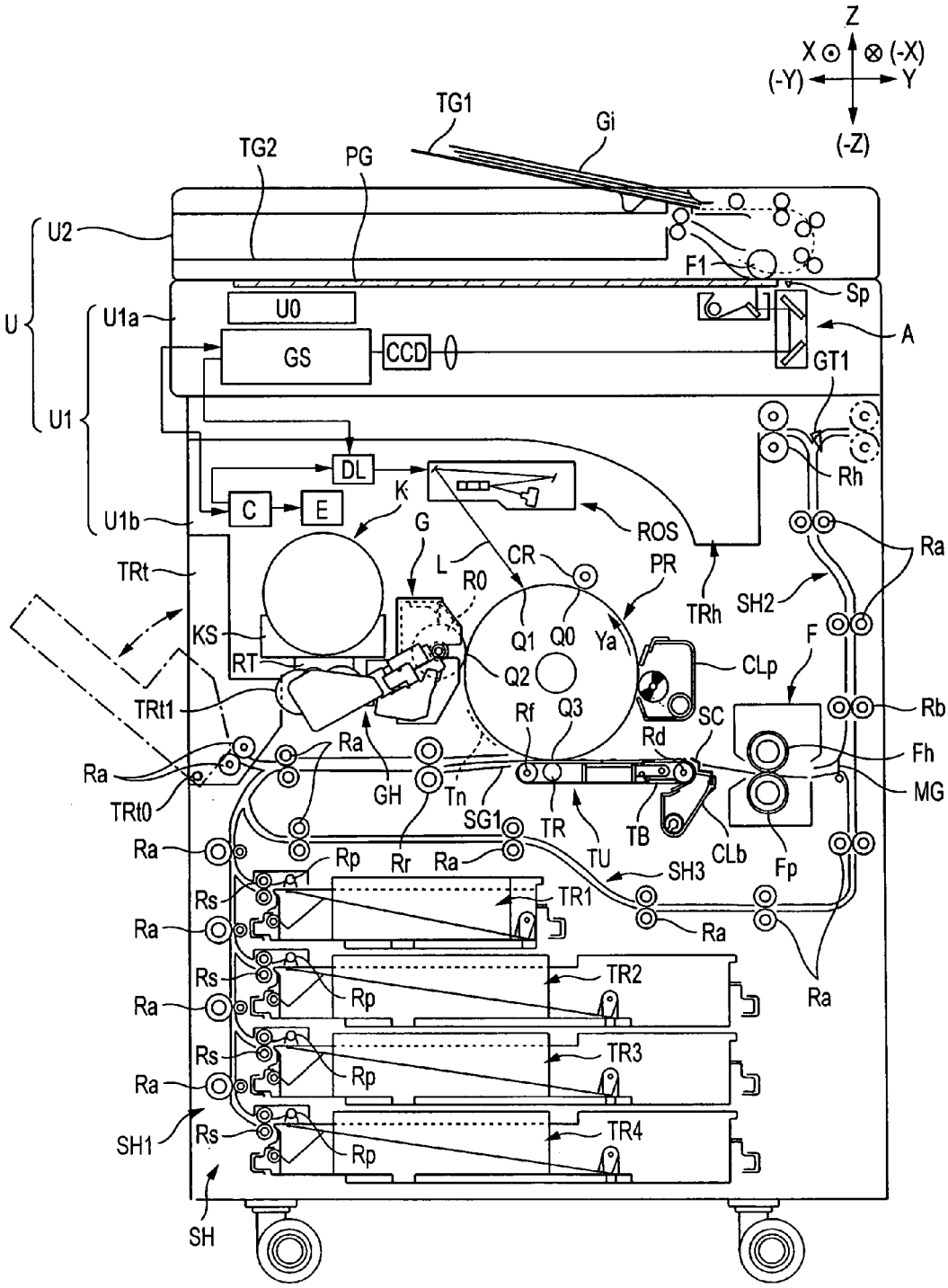
FIG. 1 is a diagram showing an image forming apparatus provided with a developer transport apparatus of an exemplary embodiment 1 of this invention.

In the figures, ROS is a laser exposure device, Rh is a sheet discharge roll, and SN is a detection surface of a toner density sensor.

DETAILED DESCRIPTION

Hereinafter, exemplary embodiments of this invention (hereinafter referred to as Embodiments) will be described with reference to drawings, and this invention is not limited to the following Embodiments.

In the drawings, in order to facilitate understanding of the following description, a cross direction is set to an X axis direction; a horizontal direction is set to a Y axis direction; a vertical direction is set to a Z axis direction; and arrows X, −X, Y, −Y, Z, −Z each indicates a frontward direction, a rearward direction, a rightward direction, a leftward direction an upward direction, a downward direction or a front part, a rear part, a right part, a left part, an upper part, and a lower part. Also, a circle in which • is added indicates that the arrow is in a direction oriented from the back to the front of the sheet, and a circle in which x is added indicates that the arrow is in a direction oriented from the front of the sheet to the back of the sheet.

In the description using the drawings, members other than those required for the description are omitted when so required for ease of understanding.

Embodiment 1

FIG. 1 is a diagram showing an image forming apparatus provided with a developer transport apparatus of exemplary Embodiment 1 of this invention.

Referring to FIG. 1, an image forming apparatus U is provided with a digital copier U1 serving as an image forming apparatus main body having on its top surface a platen glass PG which is a transparent document platform and an automatic document feeder U2 mounted attachably/detachably on the platen glass PG.

The automatic document feeder U2 has a document feed tray TG1 on which plural sheets of documents G1 to be copied are placed in piles. The automatic document feeder U2 has such a structure that the plural documents G1 placed on the document feed tray TG1 are caused to pass sequentially through a copy position on the platen glass PG to be discharged to the document discharge tray TG2.

The copier U1 has an operation instruction input unit U0 to be used by an operator for inputting instructions, an image reading unit U1*a* and an image recording unit U1*b* that are disposed under the platen glass PG in this order, and an image processing unit GS provided in the image reading unit U1*a* or the image recording unit U1*b*.

The image reading unit U1*a* which is a document reader disposed under the transparent platen glass PG on the top face of the copier main body U1 has an exposure system registry sensor (platen registry sensor) Sp disposed at a position of a platen registry position (OPT position) and an exposure optical system A.

Movement and stoppage of the exposure optical system A are controlled by detection signals of the exposure system registry sensor Sp, and the exposure optical system A is usually stopped at a home position.

In the case of an automatic document feed mode where copying is performed by using the automatic document feeder U2, the exposure optical system A is stopped at the home position for executing exposure on the documents G1 sequentially passing through the copy position F1 on the platen glass PG.

In the case of a platen mode where the operator places a document G1 on the platen glass PG for copying, the exposure optical system A performs exposure scan of the document on the platen glass PG while moving.

Light reflected from the exposed document G1 is focused via the exposure optical system A on a CCD which is a solid imaging element. The CCD converts the light reflected from the document and focused on its imaging surface into electrical signals.

The image processing unit GS converts the read image signals inputted from the CCD of the image reading unit U1*a* into digital image write signals to output the digital image write signals to a laser driving signal output device DL of an image forming unit U1*b*.

The laser driving signal output device DL outputs laser driving signals corresponding to the inputted image data to an exposure device (optical write scanning device or an image write device).

A photoreceptor drum PR disposed under the exposure device rotates in a direction of an arrow Ya. A surface of the photoreceptor drum PR is charged to −700 V by a charge roll CR in a charging region Q0 and then exposure-scanned by a laser beam L of the exposure device at a latent image write position Q1, so that a latent image of −300 V is formed. The surface of the photoreceptor drum PR on which the latent image is formed is rotationally moved to pass through a developing region Q2 and a sheet transfer region Q3.

In the developing region Q2, a developing device G developing the latent image transports a developer containing a negatively charged toner and a positively charged carrier to the developing region Q2 by a developing roll R0 to develop the latent image passing through the developing region Q2, thereby obtaining a toner image. The toner image on the surface of the photoreceptor drum PR is conveyed to the sheet transfer region Q3.

A cartridge (developer container) K for refilling the developer to be consumed in the developing device is mounted attachably/detachably on a cartridge mounting member KS. The developer inside the cartridge K is transported with stirring by a developer container RT and transported to the developing device G by a developer transport apparatus GH disposed in the developer container RT.

A transfer unit TU opposed to the photoreceptor drum PR in the sheet transfer region Q3 is rotatably supported by belt support rolls (Rd, Rf) having a driving roll Rd and a driven roll Rf and has a transfer belt TB, a transfer roll TR, and a separation claw SC, a belt cleaner CLb, and the like. The transfer roll TR is a member for transferring the toner image on the surface of the photoreceptor drum PR onto a sheet S, and a transfer voltage which has a polarity reverse to that of the development toner used in the developing device is supplied from a power circuit E to the transfer roll TR. The power circuit E is controlled by a controller which is one embodiment of a controller.

The sheets S housed in sheet feed trays TR1 to TR4 are fed to the sheet transfer region Q3 via the sheet supply path SH1. More specifically, the sheets S which are one embodiment of mediums in the trays TR1 to TR4 are picked up by a pickup roll Rp at a predetermined timing and separated from one another by a separation roll Rs to be conveyed to the registry roll Rr by plural feed rolls Ra.

A manual feed tray TRt which is one embodiment of the manual sheet feeder is disposed on a left side of the cartridge mounting member KS and the developer container RT (−Y side of FIG. 1), and a sheet S fed from the manual feed tray TRt is also sent to the predetermined sheet transfer region Q3. In the image forming apparatus U of Embodiment 1, the manual feed tray TRt is rotatably supported about a rotation center TRt0, and, when the manual feed tray TRt is housed inside the image forming apparatus U, a part of TRt1 near the rotation center TRt0 of the manual tray TRt is inserted into a space under the cartridge mounting member KS and on the left of the developer container RT (see the thick line in FIG. 1), so that the manual feed tray TRt is housed with the image forming apparatus being small footprint and compact as a whole.

The sheet S conveyed to the registry roll Rr is conveyed to the transfer belt TB of the transfer unit TU from a pre-transfer sheet guide SG1 at a timing when the toner image on the photoreceptor drum PR is moved to the sheet transfer region Q3. The transfer belt TB conveys the thus-conveyed sheet S to the sheet transfer region Q3.

The toner image Tn developed on the surface of the photoreceptor drum PR is transferred on the sheet S by the transfer roll TR in the sheet transfer region Q3. After the transfer, the surface of the photoreceptor drum PR is cleaned by a photoreceptor cleaner CLp for the purpose of removing a remaining toner and then charged again by, the charge roll CR.

The sheet S on which the toner image is transferred by the transfer roll TR in the sheet transfer region Q3 is separated from the surface of the transfer belt TB by the sheet separation claw SC at a downstream from the sheet transfer region Q3. The separated sheet S is conveyed to a feed roll Rb that is capable of forward and reverse rotations on a sheet discharge path SH2 after the toner image is heat-fixed by a fixing device F having a heat roll Fh and a pressure roll Fr and passing through a mylar gate MG made from an elastic sheet. After the sheet S has passed through the fixing device F, the mylar gate is elastically deformed to direct the sheet S to the sheet discharge path SH2.

The sheet S to be discharged to the discharge tray TRh is conveyed on the sheet discharge path SH2 on which the feed roll Rb capable of forward and reverse rotations and plural feed rolls Ra are disposed. A switching gate GT1 is disposed on a downstream end of the sheet discharge path SH2. The switching gate GT1 is switched so as to discharge the sheet S conveyed thereto to either one of the discharge tray TRh or a post-processing apparatus (not shown) in the case where the post-processing apparatus is connected to the image forming apparatus. When the post-processing apparatus is not provided, the switching gate GT1 discharges the sheet S conveyed to the downstream end of the sheet discharge path SH2 to the discharge tray TRh.

When a sheet which is printed on one side is conveyed to the feed roll Rb capable of forward and reverse rotations in a both side printing, the feed roll Rb rotates in the reverse direction immediately before a trailing end of the one-side printed sheet S passes through the feed roll Rb to switch back the one-side printed sheet S. The mylar gate MG directs the sheet S which has been switched back from the feed roll Rb to a sheet circulation conveying path SH3. The one-side printed sheet S conveyed to the sheet circulation conveying path SH3 is sent again to the transfer region Q3 in a state where the one-side printed sheet S is turned over. A toner image is transferred on a second side of the one-side printed sheet S sent to the sheet transfer region Q3.

A sheet conveying device SH is formed of the component parts indicated by SH1 to SH3, Rp, Rs, Ra, Rb, MG, and so on.

(Developing Device)

Figure 2:
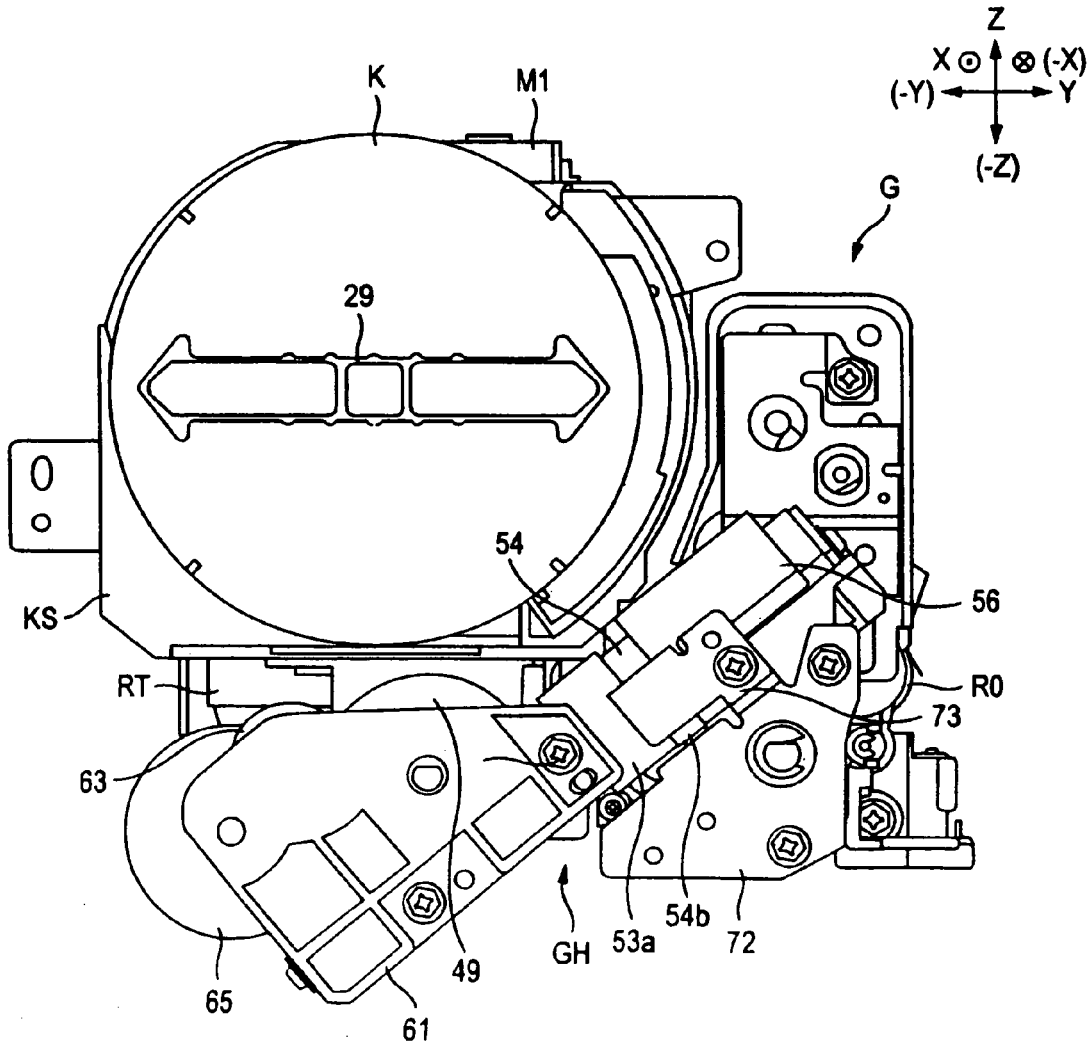
FIG. 2 is a front view showing a developer supply device which is the developer transport apparatus of the image forming apparatus of Embodiment 1 of this invention and a developing device.

FIG. 2 is a front view showing a developer supply device which is the developer transport apparatus of the image forming apparatus of Embodiment 1 of this invention and a developing device.

Figure 3:
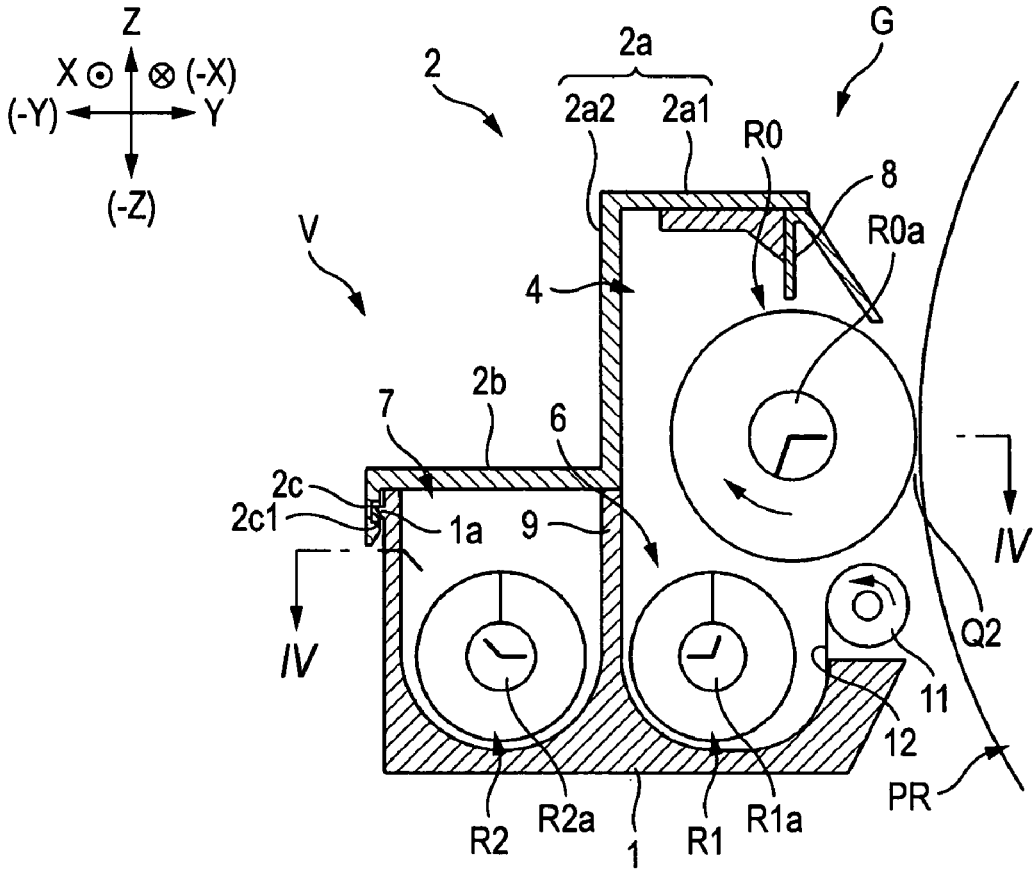
FIG. 3 is a diagram showing the developing device shown in FIG. 2.

FIG. 3 is a diagram showing the developing device shown in FIG. 2.

Figure 4:
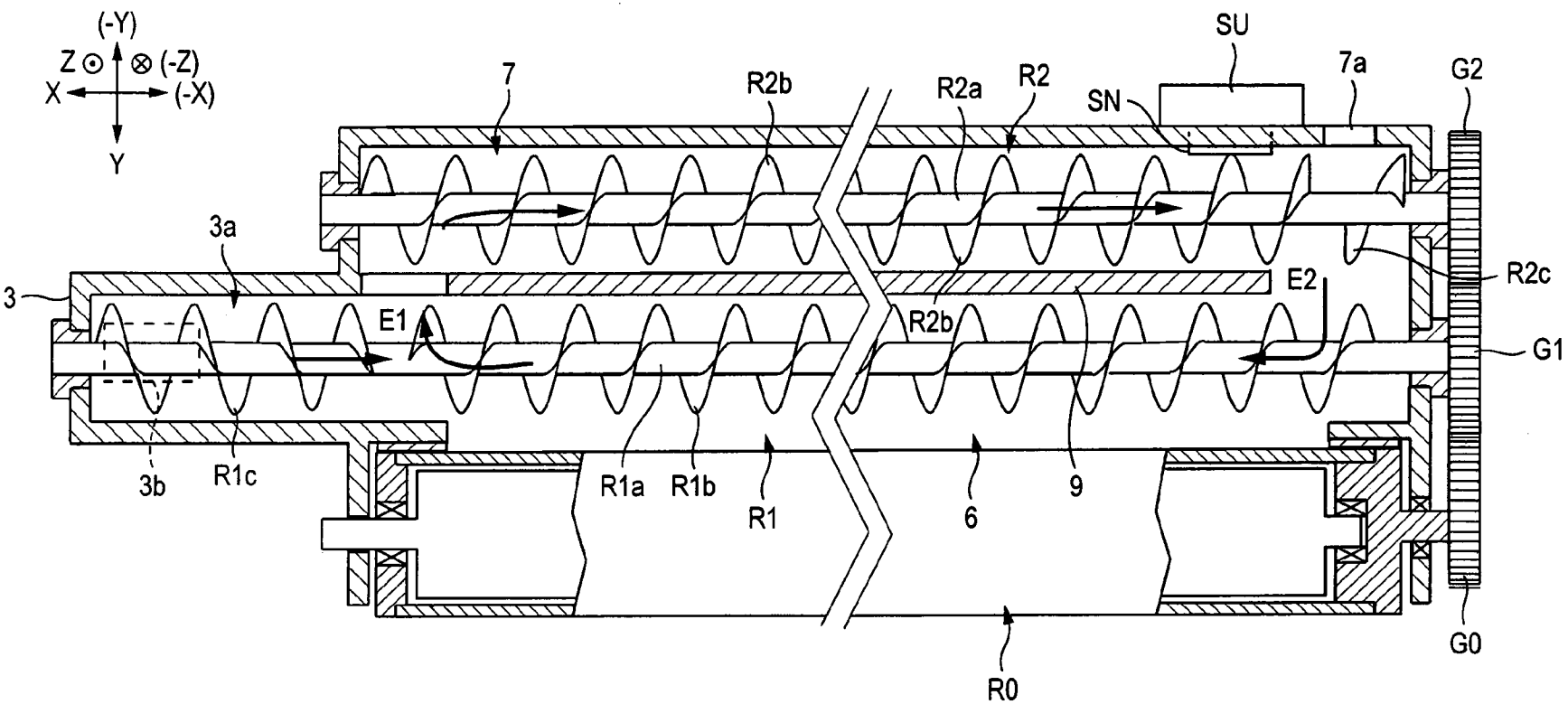
FIG. 4 is a sectional view taken along the line IV-IV of FIG. 3A.

FIG. 4 is a sectional view taken along the line IV-IV of FIG. 3A.

Referring to FIGS. 2 to 4, the developing device opposed to the photoreceptor drum PR in the developing region Q2 has a developing vessel V for housing a two-component developer containing a negatively charged toner and a positively charged carrier (see FIG. 3). The developing vessel V has a developing vessel main body 1, a developing vessel cover 2 for covering the developing vessel main body 1 and its upper end, and a developer supply cylinder (developer inlet cylinder) 3 connected to a front end of the developing vessel main body 1 (see FIG. 4).

Referring to FIG. 3, the developing vessel main body 1 has a developing roll chamber 4 for housing the developing roll R0, a first stirring chamber 6 disposed adjacent to the developing roll chamber 4, and a second stirring chamber 7 disposed adjacent to the first stirring chamber 6, which are provided inside the developing vessel main body 1. The developing vessel cover 2 has a roll housing wall 2*a* forming the developing roll chamber 4, an upper wall 2*b* disposed on the second stirring chamber 7, and a locked wall 2*c* extending downward from the left (−Y side in FIG. 3) of the upper wall 2*b* and abutting to a side wall of the developing vessel main body 1. The roll housing wall 2*a* has a top wall 2*a*1 and a side wall 2*a*2, and a layer thickness regulation member 8 for regulating a layer thickness of the developer on the surface of the developing roll R0 when the developing vessel cover 2 is attached to the developing vessel main body is provided inside the developing roll chamber 4 at an inner surface of the top wall 2*a*1. When the developing vessel cover 2 is attached to the developing vessel main body 1, a locking aperture 2*c*1 (see FIG. 3) formed on the locked wall 2*c* is locked by a locking claw 1*a* formed on an outer surface of the developing vessel main body 1.

Referring to FIGS. 3 and 4, a supply chamber 3*a* inside the developer supply cylinder 3 is connected to the left of the first stirring chamber 6 (see FIG. 4). Between the first stirring chamber 6 and the second stirring chamber 7 inside the developing vessel main body 1, a partitioning wall 9 is formed on a portion other than opposite ends. Referring to FIG. 3, an upper end of the partitioning wall 9 is abutted to a lower end (end on −Z side of FIG. 3) of the side wall 2*a*2 of the roll housing wall 2*a*. The first stirring chamber 6 and the second stirring chamber 7 is connected to each other at a front communicating part E1 and a rear communicating part E2 at opposite ends in a cross direction (X axis direction), so that the developer flows into the chambers (see FIG. 4).

A circulation stirring chamber (6+7) is formed of the first stirring chamber 6 and the second stirring chamber 7.

Referring to FIG. 4, a developer discharge outlet 7*a* for gradually discharging a degraded developer by overflow is formed at the rear part of the second stirring chamber 7. A toner concentration sensor SU is disposed upstream of the developer discharge outlet 7*a*. The developer discharged from the developer discharge outlet 7*a* is collected in a developer collection vessel (not shown). A supply chamber 3*a* is formed inside the developer supply cylinder, and a supply inlet (developer inlet) 3*b* is formed on an upper part. The supply chamber 3*a* is connected to a front part of the first stirring chamber 6.

Referring to FIGS. 3 and 4, the developing roll R0 is of the conventional structure that has in its inside a built-in magnetic roll provided with a sleeve on an outer surface thereof. The developer in the first stirring chamber 6 is absorbed on the surface of the developing roll R0 by a magnetic force of the magnetic roll R0 to be conveyed to the developing region Q2. A roll shaft R0*a* of the developing roll R0 is rotatably supported by a front wall and a rear wall of the developing vessel main body 1, and a gear G0 is fixed on a rear end (end on −X side of FIG. 4) of the roll shaft R0*a*.

A seal roll 11 rotating in a direction reverse to the rotation direction of the developer is supported under the developing roll R0. A bias same as that applied to the developing roll R0 is applied to the seal roll 11, and a scraper 12 is in contact with a surface of the seal roll 11. The seal roll 11 absorbs, collects, and scrapes a toner cloud (floating toner in the form of a cloud) generated between the developing roll R0 and the photoreceptor PR in the developing region Q2 to return the toner to the first stirring chamber 6 for reuse.

Referring to FIGS. 3 and 4, a first stirring member R1 for transporting the developer with stirring is disposed inside the first stirring chamber 6 and the supply chamber 3*a*. The first stirring member R1 has a first rotation shaft R1*a* extending in an axial direction of the developing roll R0, a stirring transport blade R1*b* supported by an outer periphery of the rotation shaft R1*a*, and a reverse transport blade R1*c*. The stirring transport blade R1*b* is provided over the rear communicating part E2 and the front communicating part E1 in order to transport the developer from the rear part (−X part of FIG. 4) to the front part (+X part of FIG. 4). The reverse transport blade R1*c* (see FIG. 4) is provided inside the supply chamber 3*a* and transports the developer supplied from the supply inlet 3*b* to a direction reverse to the transport direction of the stirring transport blade R1*b*. The developer transported rearward by the reverse transport blade R1*c* and the developer transported frontward by the stirring transport blade R1*b* are transported to the second stirring chamber via the communicating part E1.

The rotation shaft R1*a* is rotatably supported by the front wall of the supply cylinder 3 and the rear wall of the developing vessel main body 1, and a gear G1 is fixed to a rear end (end in −X part of FIG. 4) of the rotation shaft R1*a*.

A second stirring member R2 for transporting the developer rearward with stirring is disposed in the second stirring chamber 7. The second stirring member R2 also has a second rotation shaft R2*a*, a stirring transport blade R2*b*, and reverse transport blade R2*c*. The stirring transport blade R2*b* is provided over the developer supply inlet 3*b* and the rear communicating part E2 in order to transport the developer from the front part (+X part of FIG. 4) to the rear part (−X part of FIG. 4). The reverse transport blade R2*c* (see FIG. 4) is provided at the rear end (−X part of FIG. 4) of the rear communicating part E2 and causes the developer to flow from the second stirring chamber 7 to the first stirring chamber 6 by transporting the developer frontward (X direction) which is the direction reverse to the transport direction of the stirring transport blade R2*b*. The rotation shaft R2*a* is rotatably supported by the front wall and the rear wall of the developing vessel main body 1, and a gear G2 is fixed to a rear end.

Referring to FIGS. 2 and 4, the gear G0 of the roll shaft R0*a* meshes with the gear G1 of the first rotation shaft R1*a*, and the gear G1 meshes with the gear G2 of the second rotation shaft R2*a*. A rotation force of a developing device motor (not shown) is transmitted to the gear G0, and the gear G1 rotates reverse to the gear G0 when the gear G0 is rotated by the motor, so that the gear G1 and the gear G2 rotate in directions reverse to each other. More specifically, the first stirring member R1 and the second stirring member R2 rotating integrally with the gear G1 and the gear G2 rotate in directions reverse to each other. Therefore, the developers in the first stirring chamber 6 and the second stirring chamber 7 circulate as being transported in directions reverse to each other by the rotations of the first stirring member R1 and the second stirring member R2.

The developing device G is formed of the supply cylinder 3, the developing vessel V, the developing roll chamber 4, the circulation stirring chamber (6+7), the first stirring member R1, and the second stirring member R2.

(Cartridge Mounting Member, Developer-Containing Unit, and Developer Supply Vessel)

Figure 5:
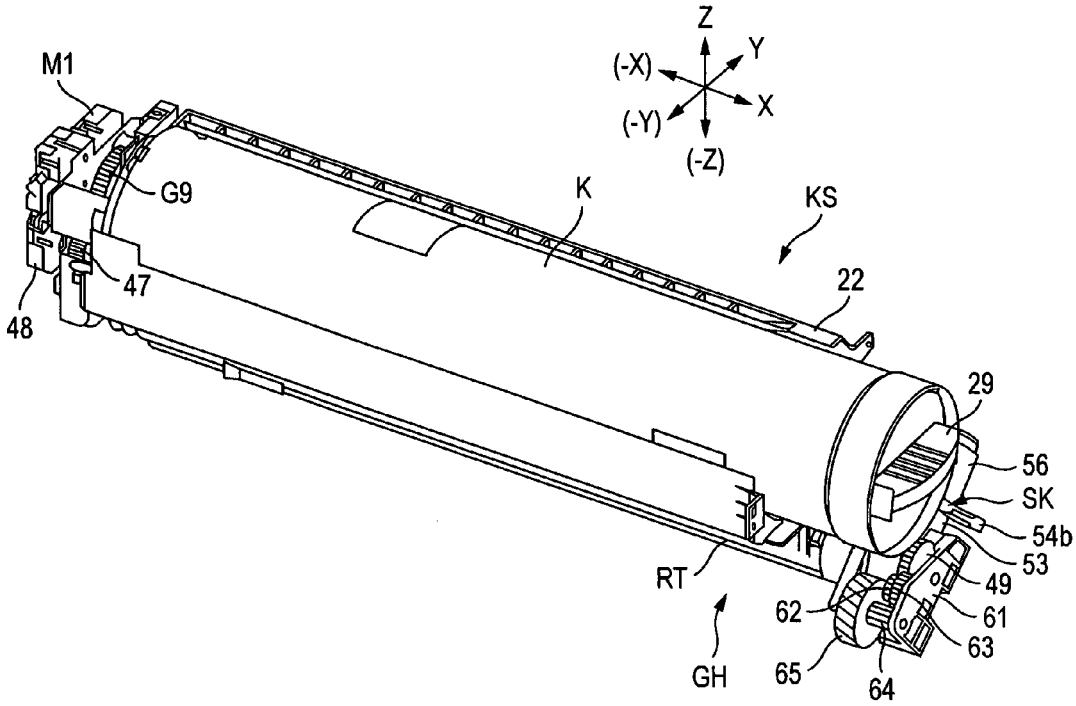
FIG. 5 is a perspective view showing a developer-containing unit which is one exemplary embodiment of the first developer-containing unit of this invention and a cartridge which is one exemplary embodiment of the developer supply vessel of this invention.

FIG. 5 is a perspective view showing a developer-containing unit which is one exemplary embodiment of the first developer-containing unit of this invention and a cartridge which is one exemplary embodiment of the developer supply vessel of this invention.

Figure 6:
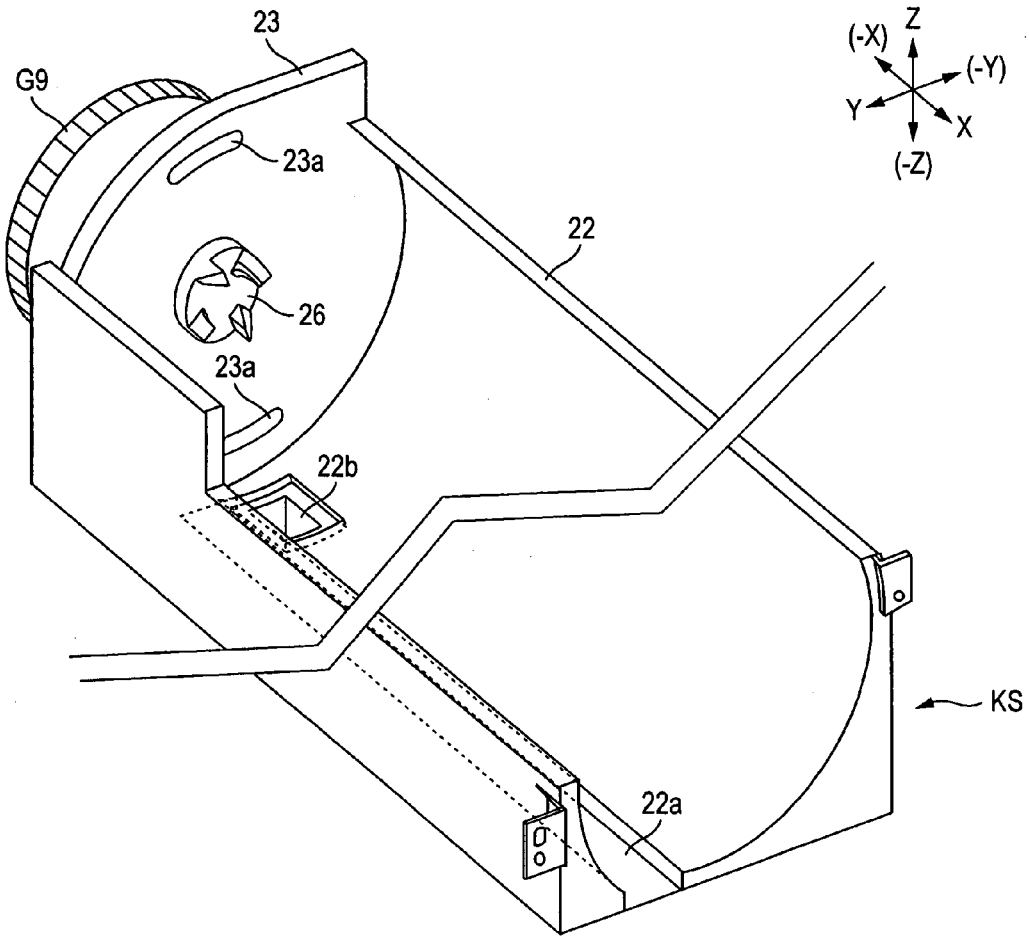
FIG. 6 is a perspective view showing a cartridge mounting part of the image forming apparatus of the embodiment 1 of this invention.

FIG. 6 is a perspective view showing a cartridge mounting part of the image forming apparatus of Embodiment 1 of this invention.

Figure 7:
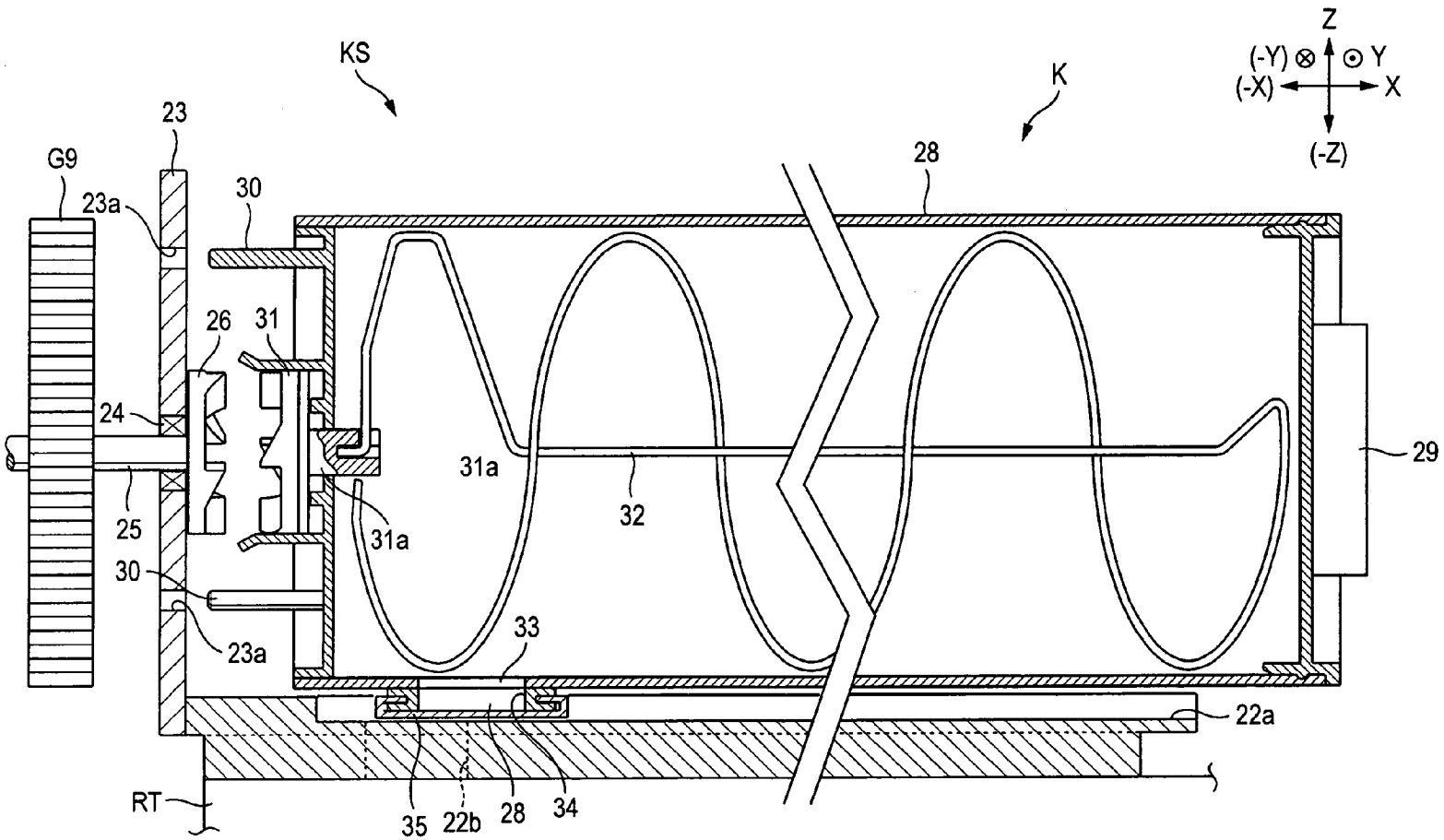
FIG. 7 is a sectional view showing the cartridge mounted on the cartridge mounting part of the image forming apparatus of the embodiment 1.

FIG. 7 is a sectional view showing the cartridge mounted on the cartridge mounting part of the image forming apparatus of Embodiment 1.

Referring to FIGS. 5 to 7, a cartridge mounting part KS is a part on which the cartridge K is attachably/detachably mounted. The cartridge mounting part KS has a semi-cylinder part 22 and a rear end wall 23. A guide groove 22*a* extending frontward and rearward and a supply inlet 22*b* connected to a rear end of the guide groove 22*a* are formed at a lower portion of an inner surface of the semi-cylinder part 22.

Two positioning pin insertion holes 23*a* and 23*a* each in the form of a circular arc are formed on the rear end wall 23. A rotation shaft 25 is rotatably supported at a central portion of the rear end wall 23 via a bearing 24 (see FIG. 7). A coupler 26 is fixed at a front end of the rotation shaft 25 penetrating through the rear end wall 23, and a gear G9 is fixed to a rear end of the rotation shaft 25. Drive is transmitted to the gear G9 from a motor (not shown) inside a motor box M1 (see FIG. 5) supported by the rear end wall 23 via a bracket.

Referring to FIG. 7, the cartridge K mounted attachably/detachably on the cartridge mounting part KS has a cartridge main body 28 in which the refill developer is contained. An operation grip 29 is provided on a front face of a front end wall of the cartridge main body 28.

Positioning pins 30 and 30 are projected from the rear end wall of the cartridge main body 28. A coupler shaft 31*a* penetrates through a central portion of the rear end wall of the cartridge main body 28, and a coupler 31 is formed at a rear end of the coupler shaft 31*a*. A rear end of an agitator 32 which is one embodiment of the developer discharging unit is coupled to a front end of the coupler shaft 31*a*.

A discharge outlet 33 for discharging the developer, a guide rail 34 extending in a circumferential direction, and a shutter 35 movable in the circumferential direction as being guided by the guide rail 34 are provided at a rear part of a cylindrical wall of the cartridge main body 28.

Referring to FIG. 7, when the cartridge K is inserted from the front to the rear, the guide rail 34 and the shutter 35 of the cartridge K move rearward as being guided by the guide groove 22*a* of the cartridge mounting part KS. When the cartridge K is inserted further rearward from the state shown in FIG. 7, the pins 30 and 30 are inserted into the circular arc-like positioning pin insertion holes 23*a* and 23*a*. In such insertion state, the coupler 31 of the cartridge K and the coupler 26 of the cartridge mounting part KS are coupled to each other.

When the cartridge K is rotated in the insertion state, the cartridge main body 28 and the guide rail 34 are rotated with the shutter being stopped. In this case, the discharge outlet 33 rotationally moves to a position communicating with the supply inlet 22*b* (see FIGS. 6 and 7). Since the supply inlet 22*b* communicates with the inner part of the developer container RT, it is possible to supply the refill developer inside the cartridge K to the developer container RT via the discharge outlet 33 and the supply inlet 22*b*.

Figure 8:
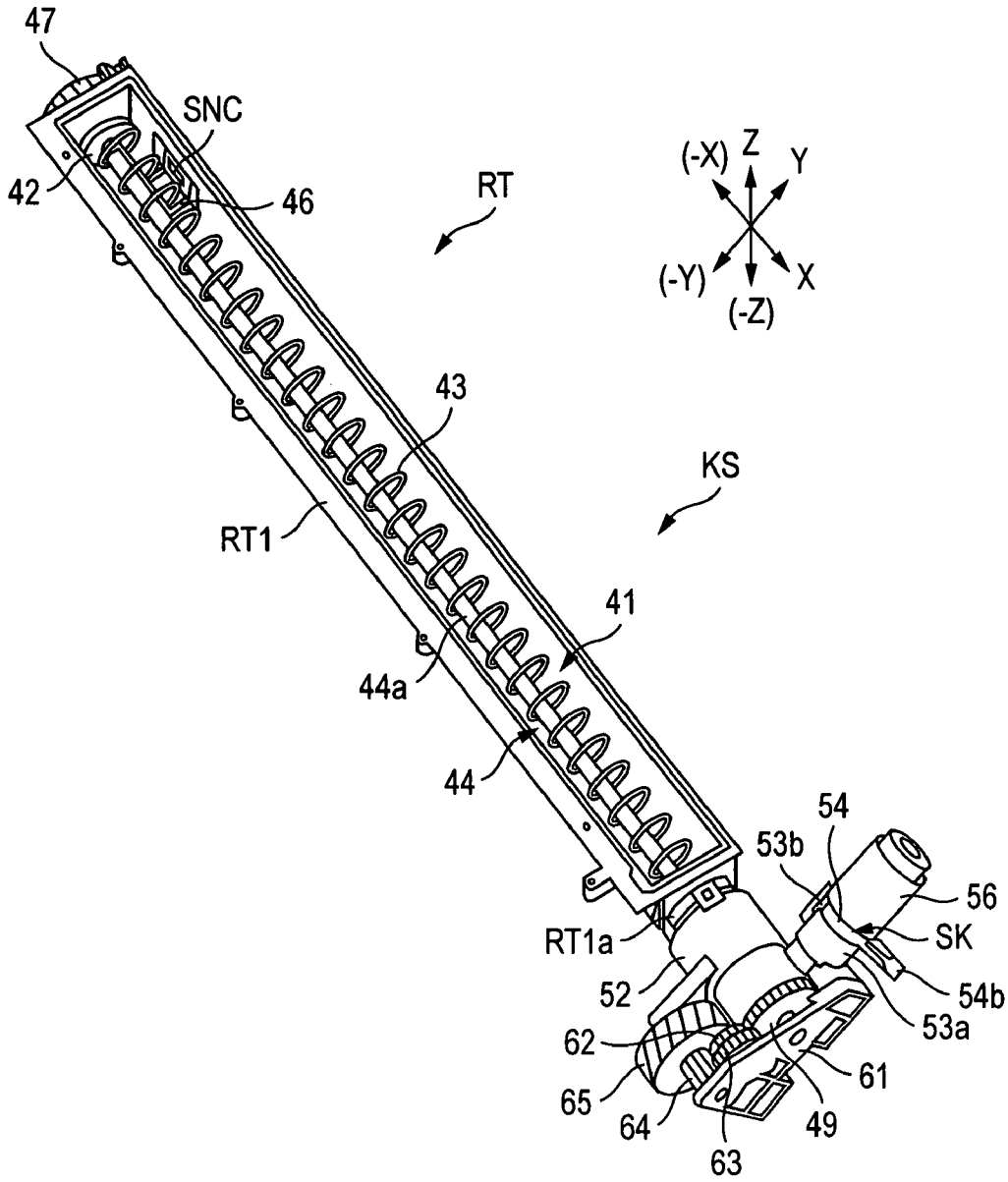
FIG. 8 is a perspective view showing the developer-containing unit of the embodiment 1.

FIG. 8 is a perspective view showing a developer-containing unit of Embodiment 1.

Figure 9:
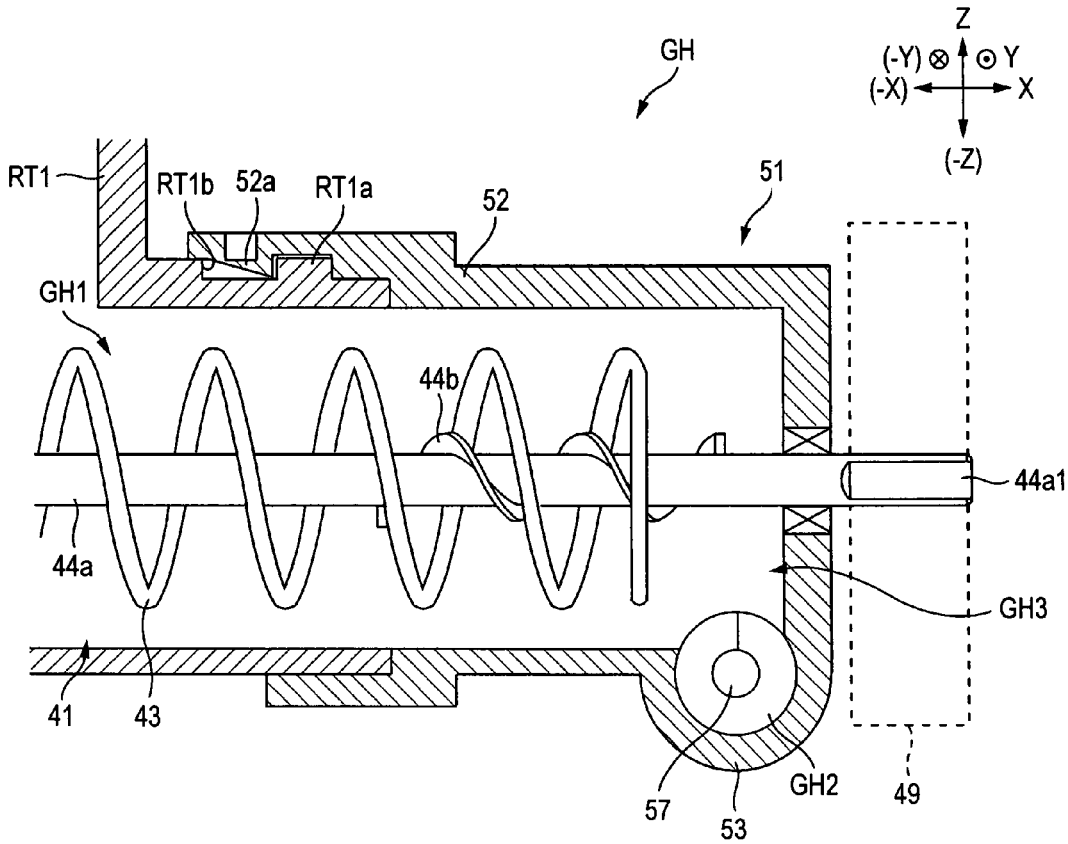
FIG. 9 is a sectional view showing a major part of a front end part of the developer-containing unit of the embodiment 1.

FIG. 9 is a sectional view showing a major part of a front end part of the developer-containing unit of Embodiment 1.

Referring to FIGS. 5 and 8, the developer container RT is supported at a lower surface of the cartridge mounting part KS. The developer container RT has a container main body RT1, and a cylindrical front end part RT1*a* (see FIG. 9) is formed on a front end part thereof. An engagement groove RT1*b* extending along the circumferential direction is formed on an upper surface of the front end part RT1*a*.

Referring to FIG. 8, the developer of the cartridge K is supplied to a rear end part of the container main body RT1 via the supply inlet 33, and a developer amount sensor SNC which is one embodiment of a detector detecting the developer is mounted on a right side wall of the container main body RT1. In the image forming apparatus U of Embodiment 1, the motor in the motor box M1 of the cartridge mounting part KS is driven by a controller C for a predetermined period of time based on a detection result of the developer amount sensor SNC, so that a predetermined amount of the developer is supplied from the cartridge K to the developer container RT.

Figure 10:
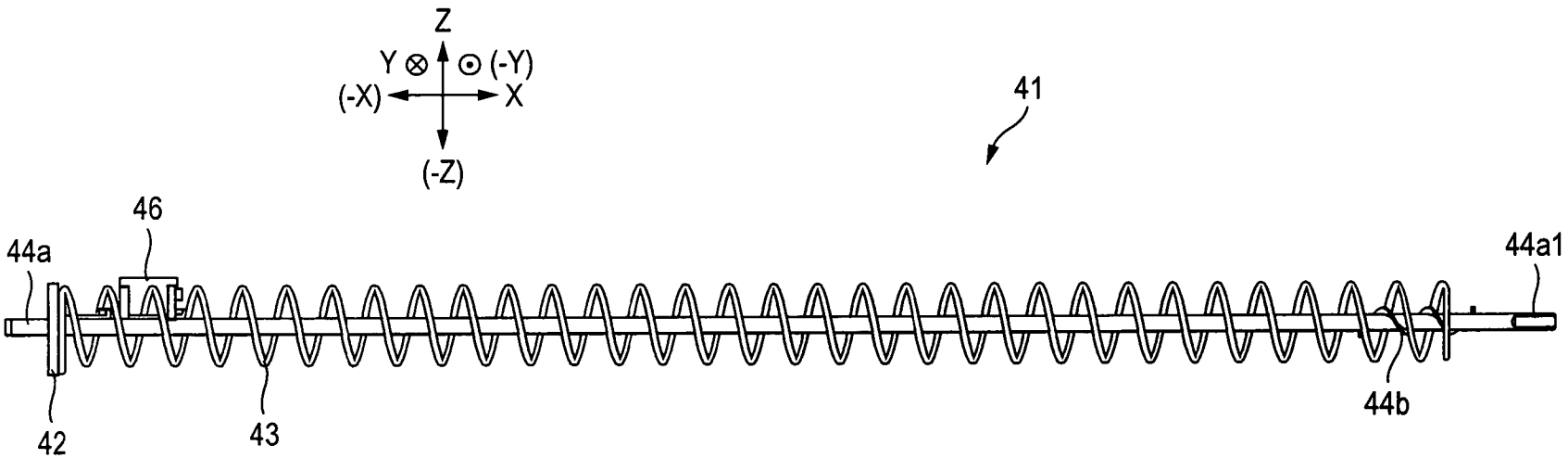
FIG. 10 is a diagram showing a developer stirring transport member disposed inside the developer-containing unit of the embodiment 1.

FIG. 10 is a diagram showing a developer stirring transport member disposed inside the developer-containing unit of Embodiment 1.

Referring to FIGS. 8 to 10, a developer stirring transport member 41 is disposed in the container main body RT1 of the developer container RT. Referring to FIGS. 8 and 10, the developer stirring transport member 41 has an auger holder 42 which is one embodiment of an end support member rotatably supported by a rear end wall of the container main body RT1, a coil-like stirring transport member 43 of which a rear end is supported by the auger holder 42, which is one embodiment of the first developer transport member, and a developer leveling member 44 which is one embodiment of the second developer transport member supported in a state where a rear end thereof is supported by the auger holder 42 while supporting the coil-like stirring transport member 43 by penetrating inside the stirring transport member 43.

The stirring transport member 43 transports the developer inside the developer container RT from the rear to the front (see +X direction of FIG. 8) which is a first developer transport direction when it is rotated.

The developer leveling member 44 has a rotation shaft 44*a* which penetrates inside the coil-like stirring transport member 43 and is disposed along a rotation center axis of the stirring transporting member 43, and a spiral transport blade (leveling part) 44*b* is formed at a front end part of an outer surface of the rotation shaft 44*a*. A front end part of the developer leveling member 44 is a so-called screw auger, which is formed of a rotation shaft and a blade-like transporting part formed around the rotation shaft and capable of transporting the developer in the axial direction and leveling the developer transported by the stirring transport member 43.

An upstream portion in the first developer transport direction of the transporting blade 44*b* of Embodiment 1 overlaps with a downstream portion in the first developer transport direction of the stirring transport member 43, and the rest portion of the transporting blade 44*b* is formed in a region which is in front of the read end of the stirring transport member 43.

A diameter of the transporting blade 44*b* is smaller than that of the stirring transport member for the purpose of keeping a capability of transporting the developer, which is a transport amount of the developer per unit time, of the transporting blade 44*b* smaller than that of the stirring transport member 43. Also, by forming the stirring transport member 43 in the form of the hollow coil, the stirring transport member 43 is overlapped with the transporting blade 44*b* in its inside.

An elastic sensor cleaning member 46 formed by bending a wire in the letter of U is supplied at a part of the rotation shaft 44*a* corresponding to the developer amount sensor SNC, and the sensor cleaning member 46 cleans a detection surface of the developer amount sensor SNC by contacting the detection surface at a predetermined interval along with the rotation of the rotation shaft 44*a*.

A transport member driving gear 47 (see FIG. 8) is fixed to and supported by a rear end of the rotation shaft 44*a*, so that a drive from a motor (not shown) in a transport member motor box 48 (see FIG. 5) is transmitted thereto. Therefore, when the auger holder 42 rotates via the rotation shaft 44*a*, the stirring transport member 43 rotates to transport the developer inside the developer container RT from the rear to the front which his one embodiment of the developer transport direction (from −X direction to +X direction of FIG. 8). In the case where a inflow rate of the developer flown from the cartridge K to the developer container RT by the motor box M1 of the cartridge mounting part KS is represented by x (g/s), and a developer transport rate (developer transport amount per unit time=first developer transport rate) of the developer leveling member 44 by the rotation that is transmitted from the motor box 48 is represented by y (g/s), x>y is maintained in order to prevent shortage (depletion) of the developer inside the developer container RT. More specifically, the transport capability of the developer leveling member 44 is kept lower than that of the agitator 32.

Referring to FIG. 9, a D-surface (gear support part) 44*a*1 which is partially cut and has a D-shaped section is formed on a front end part of the rotation shaft 44*a*, and a drive transmission gear 49 having a through hole corresponding to the D-shaped section is supported by the D-surface 44*a*1. Therefore, since the drive transmission gear 49 is retained by the D-surface 44*a*1, the drive transmission gear 49 rotates with the rotation of the rotation shaft 44*a*.

Figure 11:
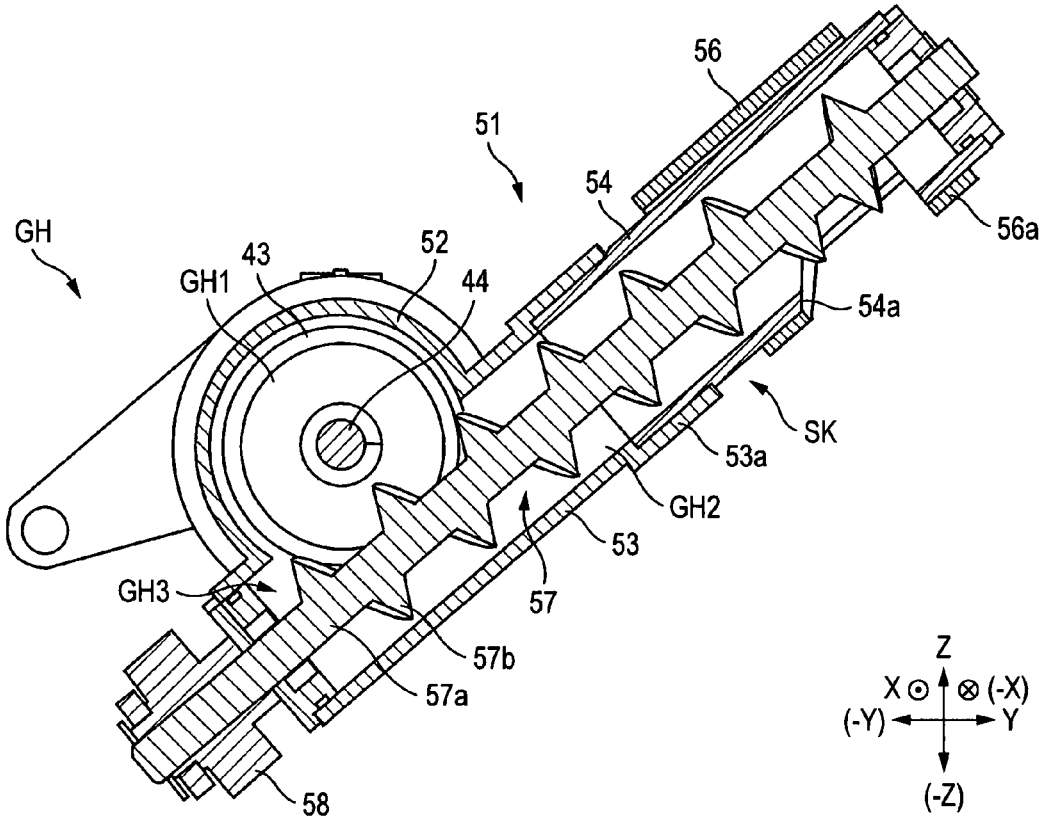
FIG. 11 is a sectional view showing a major part of an inclined transport member of the embodiment 1.

FIG. 11 is a sectional view showing a major part of an inclined transport member of Embodiment 1.

Figure 12:
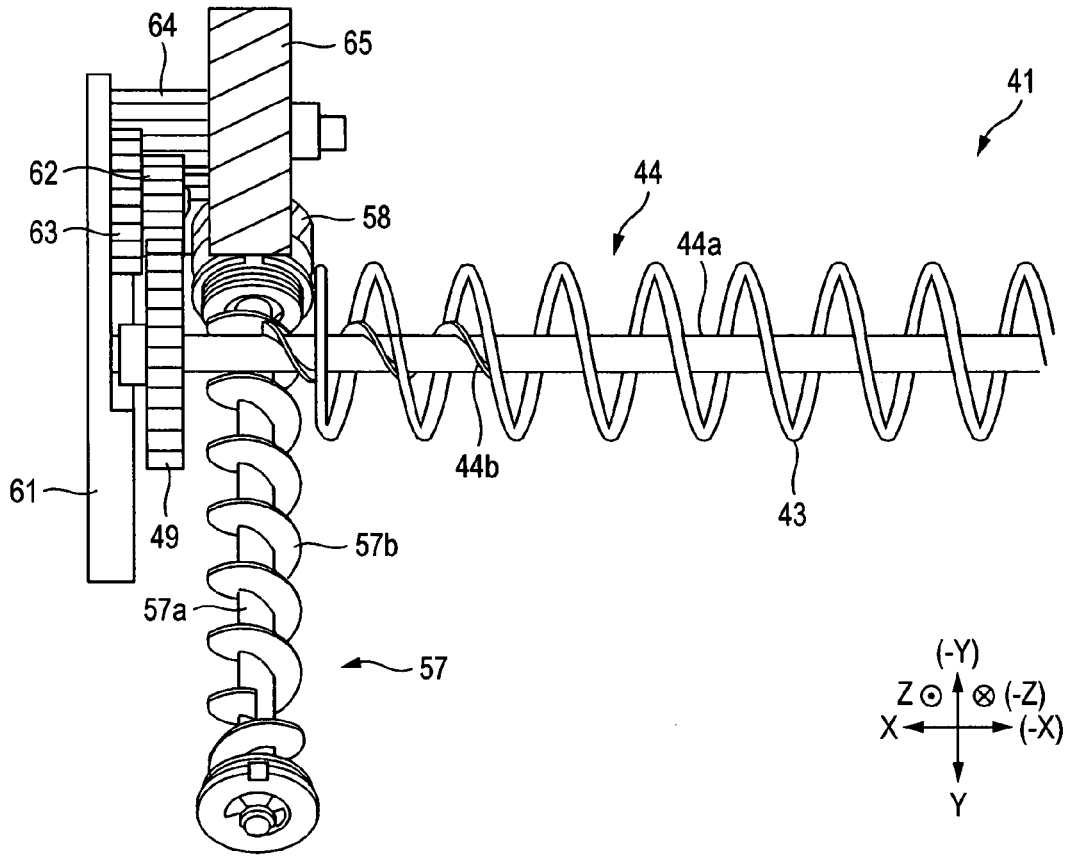
FIG. 12 is an illustration of a positional relationship and drive transmission system of the developer transport member of the developer transport apparatus of the embodiment 1.

FIG. 12 is an illustration of a positional relationship and drive transmission system of the developer transport member of the developer transport apparatus of Embodiment 1.

Figure 13:
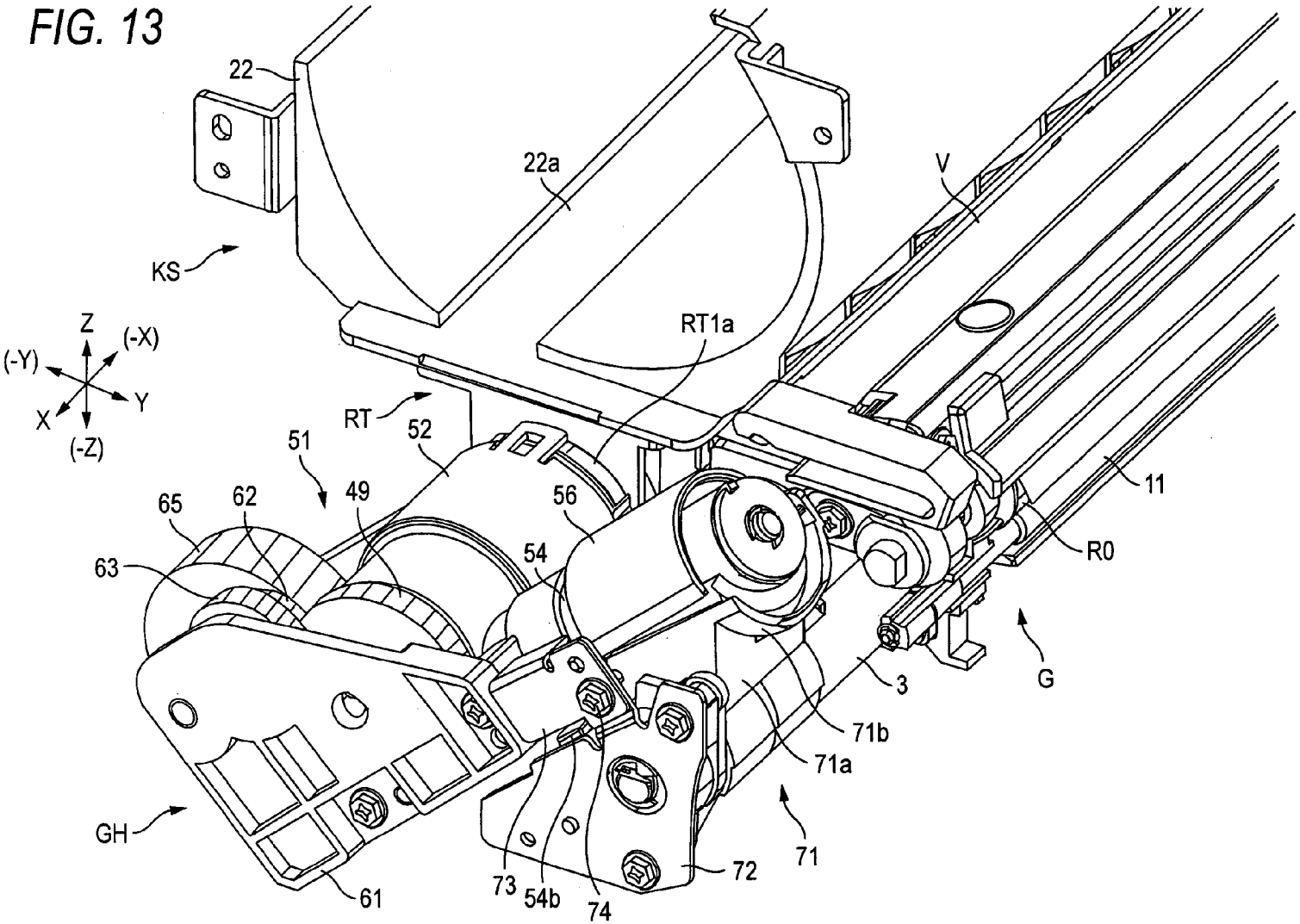
FIG. 13 is a perspective view showing a major part of the developer transport apparatus of the embodiment 1 when the developer transport apparatus is connected to a developing device.

FIG. 13 is a perspective view showing a major part of the developer transport apparatus of Embodiment 1 when the developer transport apparatus is connected to a developing device.

Figure 14:
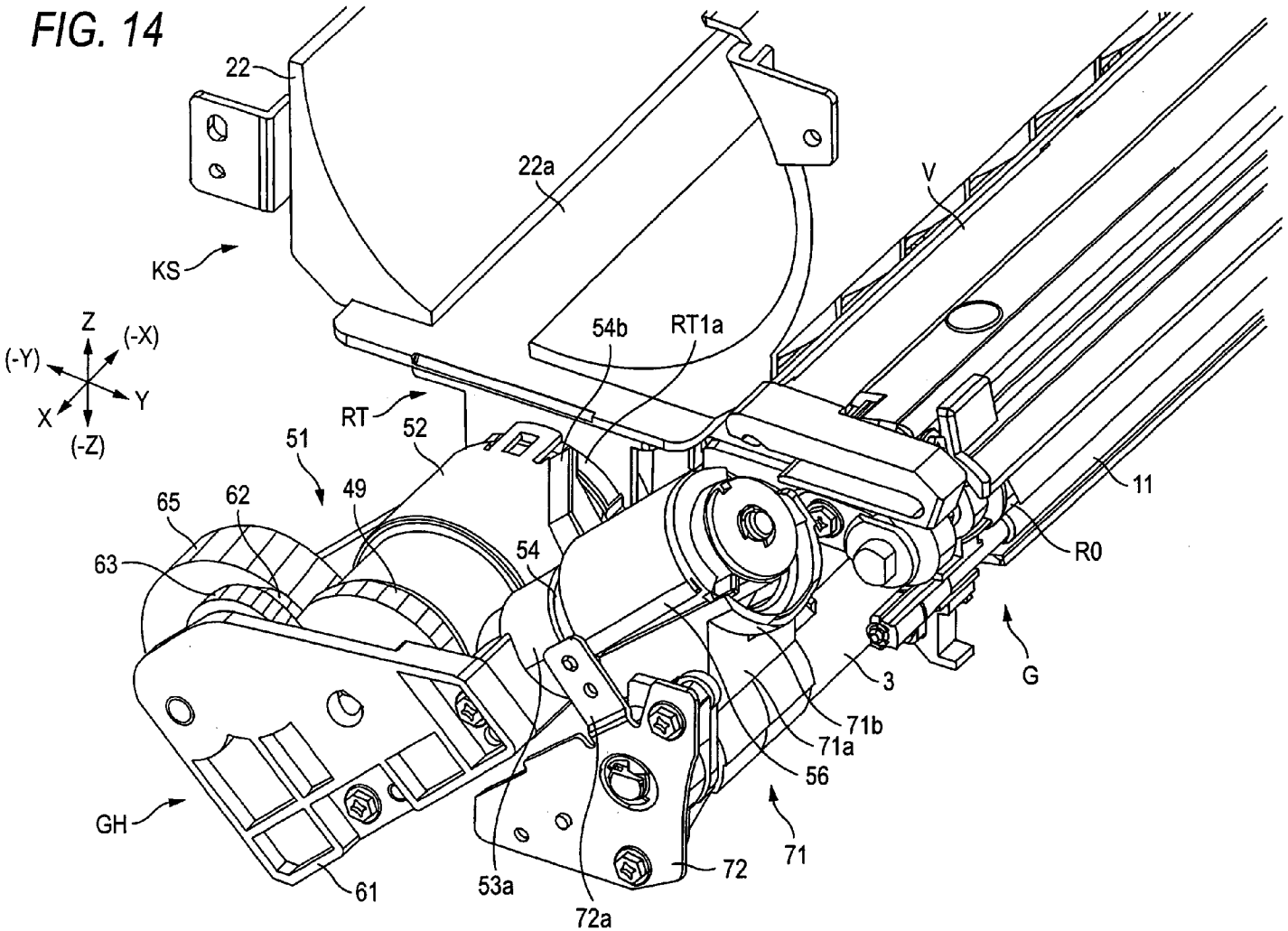
FIG. 14 is a perspective view showing a major part of the developer transport apparatus of the embodiment 1 when a shutter member is closed.

FIG. 14 is a perspective view showing a major part of the developer transport apparatus of Embodiment 1 when a shutter member is closed.

Figure 15:
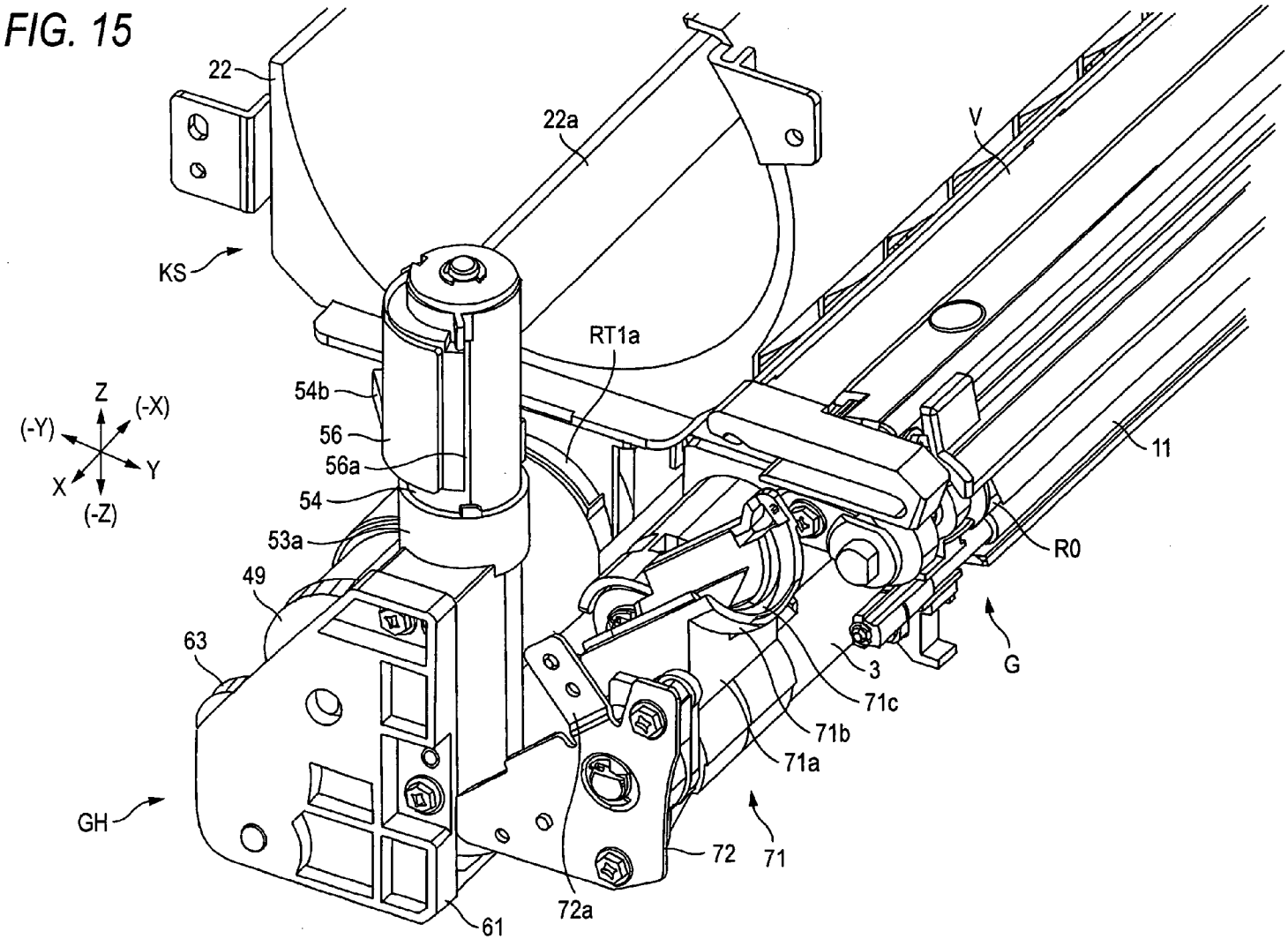
FIG. 15 is a perspective view showing a major part of the developer transport apparatus of the embodiment 1 when the developer transport apparatus is detached from the developing device.

FIG. 15 is a perspective view showing a major part of the developer transport apparatus of Embodiment 1 when the developer transport apparatus is withdrawn from the developing device.

Referring to FIGS. 8, 9, 11, and 13 to 15, an inclined transport path forming member 51 is supported by a cylindrical front end part RT1*a* of the developer container RT. The inclined transport path forming member 51 has a delivery cylinder part 52 into which the cylindrical front end part RT1*a* is inserted and fitted and a cylindrical inclined cylinder part 53 which is formed integrally at a lower portion of a front end of the delivery cylinder part 52 and extends toward diagonally upward right. An engagement claw 52*a* (see FIG. 9) engaging with an engagement groove RT1*b* of the front end part RT1*a* is formed at a rear end part of the cylinder part 52. Therefore, the inclined transport path forming member 51 is supported by the engagement RT1*b* formed along the circumferential direction and the engagement claw 52*a* at the front end part RT1*a* of the developer container RT with the inclined transport path forming member 51 being rotatable and prevented from coming off. Therefore, in the developer transport apparatus GH of Embodiment 1, a stirring transport path GH1 which is one embodiment of the first developer-containing unit is formed by the space continuing from the developer container RT to the delivery cylinder part 52.

Referring to FIGS. 8 and 11, a cylindrical shutter support member 53*a* is formed at a right upper end of the inclined cylinder part 53, and a joint pipe support member 53*b* (see FIG. 8) is formed on an outer surface of a rear end part of the shutter supporting part.

Referring to FIG. 11, a cylindrical shutter member 54 is inserted into the shutter supporting part 53*a*, and a shutter aperture 54*a* is formed at a right upper end of the shutter member 54. Referring to FIG. 8, a shutter opening/closing handle 54*b* is formed on an outer periphery of the shutter member 54. Therefore, in the developer transport apparatus GH of Embodiment 1, an inclined transport path GH2 which is one embodiment of the second developer-containing unit is formed by a cylindrical space continuing from the inclined cylinder part 53 to the shutter member 54. A developer delivery part GH3 which is one embodiment of the developer discharging unit that discharges the developer from the stirring transport path GH1 and delivers the developer to the inclined transport path GH2 is formed between the inclined transport path GH2 and one end of the stirring transport path GH1. The developer delivery part GH3 is disposed under the spiral blade 44*b* and the rotation shaft 44*a*, i.e. in a projection region as viewed from a vertically upward direction and has such a structure as to discharge the developer transported by the developer leveling member 44.

The developer transport paths (GH1 to GH3) serving as the developer transport path of Embodiment 1 are formed of the developer stirring transport path GH1, the inclined transport path GH2, and the developer delivery part GH3.

A joint pipe 56 enclosing the shutter member 54 is supported by a joint pipe supporting part 53*b* of the inclined cylinder part 53. An outer aperture 56*a* corresponding to the shutter aperture 54*a* is formed under the joint pipe 56. Referring to FIG. 8, a strip-shaped handle passing clearance SK which extends along the circumferential direction and allows the shutter opening/closing handle 54*b* to pass therethrough is formed between a left lower end of the joint pipe 56 and a right upper end of the shutter supporting part 53*a*. Therefore, when the shutter opening/closing handle 54*b* is manually rotated, the shutter member 54 is supported in such a manner that the shutter member 54 moves by rotation between an aperture communication position (see FIGS. 11 and 13) that allows the apertures 54*a* and 56*a* to be communicated and an aperture closed position (see FIG. 14) that allows the apertures 54*a* and 56*a* to be closed.

Referring to FIG. 11, an inclined transport member 57 serving as the second developer transport member is disposed inside the cylinder part 53 and the shutter member 54. The inclined transport member 57 is formed of a so-called screw auger and has a rotation shaft 57*a* and a transport blade 57*b* formed in the form of a spiral on an outer surface of the rotation shaft 57*a*. Referring to FIGS. 11 and 12, the inclined transport member 57 is disposed in front of the front end of the coil-like stirring transport member 43 in such a fashion as to overlap with the transport blade 44*b* of the developer leveling member 44 when viewed from a vertically upward direction (see FIG. 12).

Referring to FIGS. 11 and 12, an inclined transport member driving gear (second developer transport member driving gear) 58 is supported at a left end part of the inclined transport member 57.

Referring to FIGS. 8 and 12, a gear line support member 61 is supported at a front part of the cylinder part 53. The gear line support member 61 supports a first transmission gear 62 meshing with the drive transmission gear 49 of the developer leveling member 44, a second transmission gear 63 rotating coaxially with the first transmission gear 62, a third transmission gear 64 meshing with the second transmission gear 63, and a fourth transmission gear 65 rotating coaxially with the third transmission gear meshing with the inclined transport member driving gear 58 of the inclined transport member 57. Therefore, when the developer leveling member 44 is rotationally driven by the motor inside the transport member motor box 48 (see FIG. 5), the drive transmission gear 49 is rotated, so that the rotation is transmitted to the inclined transport drive gear 58 via the gear line of the transmission gears 62 to 65, whereby the inclined transport member 57 is rotated. Thus, the developer inside the cylinder part 53 is transported toward the apertures 54*a* and 56*a* (in the second developer transport direction).

In Embodiment 1, in order to prevent clogging at the developer delivery part GH3, i.e. so as to keep the higher transport rate at the downstream part, a gear ratio, the number of teeth, and the like of the gear line 62 to 65 are so set as to keep a relationship of $y<z$ when the developer transport rate (developer transport amount per unit time, second developer transport rate) by the inclined transport member 57 is represented by z(g/s) and the developer transport rate by the developer leveling member 44 is represented by y.

Referring to FIGS. 13 to 15, a transport path connection member 71 connected to the inclined transport path GH2 of the developer transport apparatus GH is supported at the front end part of the developer supply cylinder 3 of the developing device G. The transport path connection member 71 has a connection member main body 71*a* in which a developer falling path (developer transport path, not shown) extending in a vertical direction and a semi-cylindrical inclined transport path receiving base 71*b* integrally formed on an upper end part of the connection member main body 71*a*. On the inclined transport path receiving base 71*b*, a developer inlet 71*c* (see FIG. 15) is formed at a position corresponding to the shutter member 54 and the apertures 54*a* and 56*a* of the joint pipe 56, and the developer inlet 71*c* communicates, via the developer falling path, with the supply inlet 3*b* of the supply chamber 3*a* disposed vertically downward. A lock member supporting bracket 72 having a substantially triangle shape is supported at the front end part of the transport path connection member 71. Referring to FIGS. 14 and 15, a lock member support part 72*a* extending to the upper left is formed on an upper left part of the lock member supporting bracket 72. Referring to FIG. 13, a lock member 73 is fixed to the lock member support member 72*a* with a screw 74, and the shutter opening/closing handle 54*b* is held in a gap between the lock member 73 and the lock member supporting bracket 72 (see FIGS. 2 and 13).

Therefore, in ordinary image forming operation, the lock member 73 is screw-fixed in a state where the shutter opening/closing handle 54*b* is moved to an aperture communication position (see FIG. 13). Thus, the rotation of the shutter opening/closing handle 54*b* is regulated (locked), and, unless the lock member is detached, the shutter opening/closing handle 54*b* is fixed to the aperture communication position with the apertures 54*a* and 56*a* are communicated (see FIG. 13).

In the case of replacing the developing device G due to defect, life, or the like of the developing device G, the lock of the shutter opening/closing handle 54*b* is released by detaching the lock member 73, and it is possible to move the shutter opening/closing handle 54*b* to the aperture closed position at which the shutter aperture 54*a* and the outer aperture 56*a* are closed so as to prevent leakage of the internal developer. It is possible to attach/detach or replace the developing device G by inserting/removing the developing device G by rotating the inclined transport path forming member 51 about the front end part RT1*a* of the developer container RT from the above state (see FIG. 15).

The developer transport apparatus GH of Embodiment 1 is formed of the developer container RT, the members denoted by reference numerals 41 to 74, and the like.

In the image forming apparatus U having the developer transport apparatus GH of Embodiment 1 having the above-described structure, the developer supplied from the cartridge K to the developer container RT is transported frontward (first developer transport direction) with the agglutinated developer being stirred by the stirring transport member 43. When the developer is transported to the front end part of the stirring transport path GH1, since the developer leveling member 44 having a reduced transport capability than the stirring transport member 43 is disposed at the front end part, the developer is retained between the stirring transport path GH1 and the developer delivery part GH3 due to the difference in transport force. More specifically, even in the case where the amount of the developer to be supplied from the cartridge K to the developer container RT is fluctuated, the developer is retained downstream of the stirring transport path GH1, and, therefore, the developer is transported from the developer delivery part GH3 to the inclined transport path GH2 in a state reduced in fluctuation due to the retained developer and the transport force of the developer leveling member 44. Also, in the developer transport apparatus GH of Embodiment 1, the developer falls down (is transported) to the inclined transport path GH2 disposed downward as being leveled by the developer leveling member 44 in the developer delivery part GH3 for the prevention of solidification. The developer in the inclined transport path GH2 is transported in the diagonally upward right direction (second developer transport direction) by the inclined transport member 57 and then supplied to the developing vessel V of the developing device G via the transport path connection member 71.

EXPERIMENTAL EXAMPLES

Tests were conducted in order to confirm the effects of the structure of Embodiment 1.

Experimental Example 1

As Experimental Example 1, a coil-like member having a diameter of 30 mm is used as the stirring transport member 43, and a stainless shaft (rotation shaft 44*a*) having a diameter of 6 mm on whose outer surface a transport blade 44*b* having an outer diameter of 10 mm is formed is used a screw auger. The transport blade 44*b* is wound twice at a part overlapping with a terminal end of the stirring transport member 43 and once on a part projecting from the terminal end of the stirring transport member 43. Further, a screw auger having an outer diameter of 16 mm is used as the inclined transport member 57, and a rotation speed of the inclined transport member 57 is set to about ten times that of the developer leveling member 44 in order to establish a relationship of y<z of the rotation speed and the transport rate of the developer.

By employing such constitution, the developer is transported from a cartridge full of the developer under the parameters (motor rotation speed, etc.) achieving an average developer transport rate (average transport rate) of 0.4 g/s until the cartridge becomes empty to measure changes with time of the developer transport rate for supplying the developer to the developing device G.

More specifically, a container placed on a weigh scale is placed under the developer inlet 71*c*, and changes with time of an amount of a falling toner are measured. The weigh scale is connected to a personal computer via a USB cable to send data, and weigh measurement values obtained by the weigh scale are recorded every second. In the above-described state, the motor for transport member is driven continuously to transport the toner for one cartridge which was about 1500 g. The measurement data are sampled per second to be recorded in a file. After termination of the measurement, the data file is processed to calculate a transport rate per second. In turn, since the data as they are varied greatly, a 10-second moving average of the transport rates per second are obtained. From the-thus obtained data, a standard deviation of the toner transport rate in a part excluding a rising part and a decaying part of the transport rate is calculated to be used for comparison.

Comparative Example 1

In Comparative Example 1, a test is conducted in the same manner as in Experimental Example 1 except for omitting the developer leveling member 44.

FIG. 16 is a table showing experimental results of Embodiment 1.

Referring to FIG. 16, the standard deviation of the developer transport rate of Comparative Example 1 in which the developer leveling member 44 is not provided was 0.4 to 0.5 (g/s), while the standard deviation of Experimental Example 1 of Embodiment 1 is 0.1 to 0.2 (g/s). Therefore, from the results of the tests, it is confirmed that the provision of the developer leveling member 44 makes it possible to: transport the developer at the standard deviation (fluctuation) less than half of that of the case of omitting the developer leveling member 44; achieve a higher developer leveling effect; and transport the developer safely. In Comparative Example 1, the developer is retained in the developer delivery part GH3 immediately after the start of the developer supply to reveal the lack in stability in delivering the developer.

Embodiment 2

Figure 17:
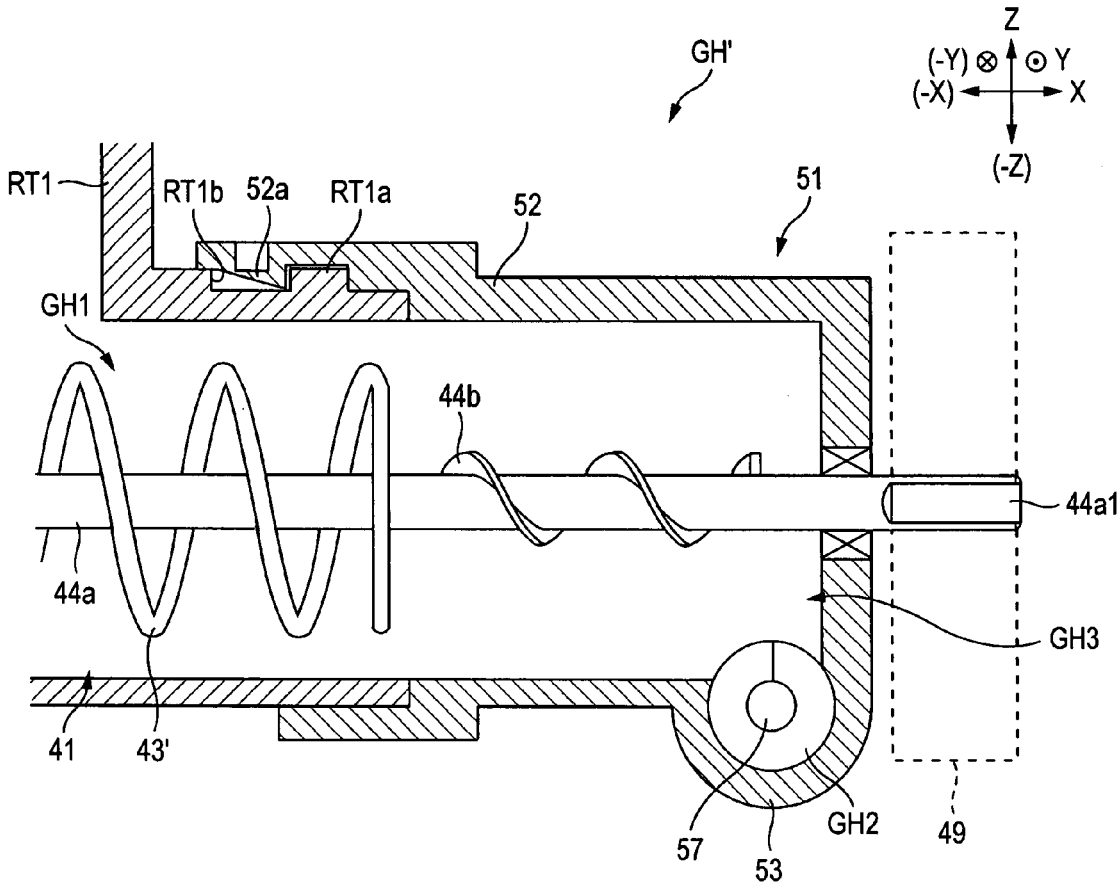
FIG. 17 is a diagram showing an exemplary embodiment 2 of this invention and corresponding to FIG. 9 of the embodiment 1.

FIG. 17 is a diagram showing exemplary Embodiment 2 of this invention and corresponding to FIG. 9 of Embodiment 1.

Hereinafter, an image forming apparatus of Embodiment 2 of this invention will be described. In the description of Embodiment 2, components corresponding to the components of Embodiment 1 are denoted by the same reference numerals to omit detailed description thereof. Embodiment 2 is different from Embodiment 1 in features described below and is in common with Embodiment 1 other than the different features.

Referring to FIG. 17, in a developer transport apparatus GH' of Embodiment 2 which is one exemplary embodiment of this invention, a stirring transport member 43' is shorter than that of Embodiment 1 so that the stirring transport member 43' is not overlapped with the stirring blade 44*b* in the first developer transport direction (from −X part to +X part of FIG. 17).

In the developer transport apparatus GH' of Embodiment 2 of this invention having the above-described structure, the developer transported by the stirring transport member 43' is transported by the transport blade 44*b* which has a lower transport capability than the stirring transport member 43'. Therefore, in Embodiment 2, as compared to Embodiment 1 wherein the developer is transported redundantly by the stirring transport member 43 and the transport blade 44*b*, the developer is more easily retained at the end of the stirring transport path GH1, so that the developer is transported downstream in a less fluctuated state.

Other than the above, the image forming apparatus U having the developer transport apparatus GH' of Embodiment 2 has the functions and effects same as those of Embodiment 1.

Embodiment 3

Figure 18:
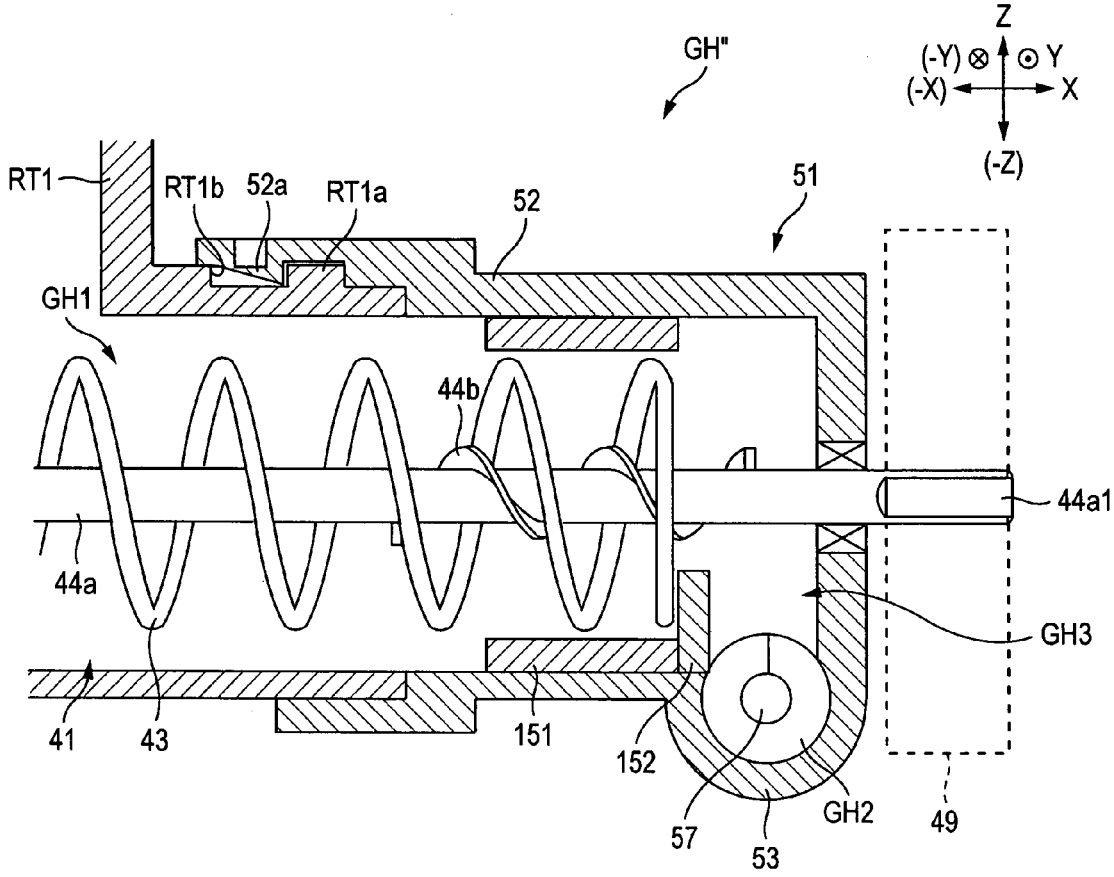
FIG. 18 is a diagram showing an exemplary embodiment 3 of this invention and corresponding to FIG. 9 of the embodiment 1.

FIG. 18 is a diagram showing exemplary Embodiment 3 of this invention and corresponding to FIG. 9 of Embodiment 1.

Hereinafter, an image forming apparatus of Embodiment 3 of this invention will be described. In the description of Embodiment 3, components corresponding to the components of Embodiment 1 are denoted by the same reference numerals to omit detailed description thereof. Embodiment 3 is different from Embodiment 1 in features described below and is in common with the Embodiment 1 other than the different features.

Referring to FIG. 18, in a developer transport apparatus GH" of Embodiment 3 which is one exemplary embodiment of this invention, a first transport amount control member 151 in a cylindrical form is provided on the inner circumference of the cylindrical part 52. A second transport amount control member 152 which is a partitioning wall-like member is provided on a front end (end on +X side of FIG. 18) of the first transport amount control member so as to further limit a developer flew from the stirring transport path GH1 into the developer delivery part.

In the developer transport apparatus GH' of Embodiment 3 of this invention having the above-described structure, since the first transport amount control member 151 reduces a transport path sectional area of the stirring transport path GH1, the developer to be transported by the stirring transport member 43 is more easily controlled and retained at the position of the first transport amount control member 151. Also, the developer transported to the first transport amount control member 151 is further reduced in transport path sectional area by a second transport amount control member, so that the developer is more easily controlled and retained. Therefore, the developer transported by the developer stirring transport member 41 is easily retained by the transport amount control members 151 and 152 at the end of the stirring transport path GH1 and is transported downstream in a state further reduced in fluctuation as compared to Embodiment 1.

Other than the above, the image forming apparatus U having the developer transport apparatus GH" of Embodiment 3 has the functions and effects same as those of Embodiment 1.

Modification Embodiments

Though Embodiments of this invention have been described in detail in the foregoing, this invention is not limited to the foregoing embodiments, and various modifications are possible in the scope of this invention recited in claims. Modification embodiments (H01) to (H08) of this invention are described below.

(H01) Though the copier is described in the foregoing Embodiments by way of embodiment of the image forming apparatus, the image forming apparatus is not limited to the copier and may be a facsimile, a printer, a complex machine provided with all or plural functions thereof. The image forming apparatus is not limited to a black and white image forming apparatus and may be a color image forming apparatus.

(H02) The shape of the developer leveling member is not limited to those described in Embodiments 1 to 4, and it is possible to adopt an arbitrary shape. For embodiment, it is possible to shorten the front part of the rotation shaft 44*a* to attach a coil-like developer leveling member having a smaller diameter than the stirring transport member 43 to the rotation shaft 44*a*.

(H03) The combination of the stirring transport member 43 and the inclined transport member 57 is not limited to the combination of the coil shape and the auger shape (rotation shaft and spiral transport blade), and it is possible to reverse the combination or to employ a conventional arbitrary shape such as a member in which a crescent-like or disk-like transport blade is supported by a rotation shaft.

(H04) Though it is desirable to set the inflow rate x and developer transport rates y and z to values satisfying the relationship of $x>y<z$, it is possible to use other relationships.

(H05) Though a fresh developer is described as the developer to be supplied from the cartridge K to the developing device G, the developer is not limited thereto, and it is possible to apply this invention to a constitution for transporting a developer such as a waste developer, paper dust, and the like collected by a cleaner and the like or to an arbitrary developer transport apparatus for transporting a developer other than the developer.

(H06) Though the structure of the stirring transport path (first developer-containing unit) GH1 extending in the cross direction, the inclined transport path (second developer-containing unit) GH2 extending in the direction of upper right, and the developer delivery part GH3 falling in the vertical direction is described in the foregoing embodiments, the structure is not limited thereto, and it is possible to change the coupling angle between the first developer-containing unit and the second developer-containing unit may be an arbitrary angle such as an acute angle and an obtuse angle, or this invention is applicable to a developer delivery part which is disposed at the same level so that the developer does not fall in the vertical direction.

(H07) Though the developer transport apparatus having, as the developer container RT, the developer-containing unit formed of one developer transport member is described in the foregoing embodiments, the developer transport apparatus is not limited to the above, and the developer container RT may be a circulation type developer-containing unit having a developer transport path and plural developer transport members.

(H08) In the foregoing Embodiments, the developer delivery part is disposed under the developer transport member, i.e. disposed in the projection region as viewed from the vertically upward direction, and discharges the developer transported by the developer transport member. However, in the case where a developer delivery part is disposed on wall surfaces around a developer transport member, a developer transported by the transport member is discharged by the discharge delivery unit, and, accordingly, such structure has the same problem as described above. Therefore, this invention is applicable to such structure.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

TABLE 1

Effect Confirmation Result (Average Transport Rate 0.4 g/s)

| Structure | Toner Transport Rate Standard Deviation (g/s) |
|---|---|
| (Comparative Embodiment) without penetration shaft | 0.4 to 0.5 |
| (Embodiment 1) with penetration shaft (with screw auger) | 0.1 to 0.2 |

What is claimed is:

1. A developer transport apparatus comprising:

a first developer-containing unit that contains a developer;

a first developer transport member disposed in the first developer-containing unit, the first developer transport member transporting the developer in a first direction;

a second developer transport member disposed downstream from the first developer transport member in the first direction, the second developer transport member transporting the developer in the first direction and having a lower capability of transporting the developer than that of the first developer transport member;

a developer discharge unit disposed in the first developer-containing unit, the developer discharge unit discharging the developer transported by the second developer transport member from the first developer-containing unit; and a second developer-containing unit that contains the developer discharged from the developer discharge unit; wherein the first developer transport member and the second developer transport member rotate in the same axis;

the first developer transport member and the second developer transport member are overlapped in a direction of transporting the developer in the first developer-containing unit; and the second developer transport member is disposed more downstream than a downstream end portion of the first developer transport member in the first direction of the first developer transport member.

2. A developer transport apparatus comprising:

a first developer-containing unit that contains a developer;

a first developer transport member disposed in the first developer-containing unit, the first developer transport member comprising a first transport unit having a first rotation diameter and rotating so as to transport the developer in a first direction;

a second developer transport member disposed downstream from the first developer transport member in the first direction, the second developer transport member comprising a second transport unit having a second rotation diameter that is smaller than the first rotation diameter, the second transport unit rotating so as to transport the developer in the first direction;

a developer discharge unit disposed in the first developer-containing unit, the developer discharge unit discharging the developer transported by the second developer transport member from the first developer-containing unit; and a second developer-containing unit that contains the developer discharged from the developer discharge unit; wherein the second developer transport member is disposed more downstream than a downstream end portion of the first developer transport member in the first direction of the first developer transport member.

3. A developer transport apparatus comprising:

a first developer-containing unit that contains a developer;

a first developer transport member disposed in the first developer-containing unit, the first developer transport member transporting the developer in a first direction;

a second developer transport member disposed downstream from the first developer transport member in the first direction, the second developer transport member transporting the developer in the first direction and having a lower capability of transporting the developer than that of the first developer transport member;

a developer discharge unit disposed in the first developer-containing unit, the developer discharge unit discharging the developer transported by the second developer transport member from the first developer-containing unit; and a second developer-containing unit that contains the developer discharged from the developer discharge unit, the first developer transport member having such a shape that enables the developer retained between the first developer transport member and the second developer transport member to flow back; wherein the second developer transport member is disposed more downstream than a downstream end portion of the first developer transport member in the first direction of the first developer transport member.

4. A developer transport apparatus comprising:

a first developer-containing unit that contains a developer;

a first developer transport member disposed in the first developer-containing unit, the first developer transport member comprising a first transport unit having a first rotation diameter and rotating so as to transport the developer in a first direction;

a second developer transport member disposed downstream from the first developer transport member in the first direction, the second developer transport member comprising a second transport unit having a second rotation diameter that is smaller than the first rotation diameter, the second transport unit rotating so as to transport the developer in the first direction;

a developer discharge unit disposed in the first developer-containing unit, the developer discharge unit discharging the developer transported by the second developer transport member from the first developer-containing unit; and a second developer-containing unit that contains the developer discharged from the developer discharge unit, the first developer transport member being a rotational transport member comprising a wire formed into a helical form; wherein the first developer transport member and the second developer transport member rotate in the same axis;

an inner diameter of the first developer transport member is larger than an outer diameter of the second developer transport member; and the second developer transport member is disposed more downstream than a downstream end portion of the first developer transport member in the first direction of the first developer transport member.

5. The developer transport apparatus according to claim 3, further comprising a retention unit disposed in the developer discharge unit, the retention unit retaining the developer.

6. The developer transport apparatus according to claim 4, further comprising a retention unit disposed in the developer discharge unit, the retention unit retaining the developer.

7. The developer transport apparatus according to claim 3, wherein the first developer transport member and the second developer transport member are overlapped in a direction of transporting the developer in the first developer-containing unit.

8. The developer transport apparatus according to claim 4, wherein the first developer transport member and the second developer transport member are overlapped in a direction of transporting the developer in the first developer-containing unit.

9. An image forming apparatus comprising:

a developer supply vessel containing a developer and being detachable from the image forming apparatus;

a developer discharging unit that discharges the developer to outside of the developer supply vessel;

a first developer-containing unit that contains a developer;

a first developer transport member disposed in the first developer-containing unit, the first developer transport member transporting the developer in a first direction;

a second developer transport member disposed downstream from the first developer transport member in the first direction, the second developer transport member transporting the developer in the first direction and having a lower capability of transporting the developer than that of the first developer transport member;

a developer discharge unit disposed in the first developer-containing unit, the developer discharge unit discharging the developer transported by the second developer transport member from the first developer-containing unit;

a second developer-containing unit that contains the developer discharged from the developer discharge unit;

a detector disposed in the first developer-containing unit, the detector detecting an amount of the developer at a position of the first developer-containing unit;

a controller that controls the discharging of the developer by the developer discharging unit, depending on a detection result of the detector; and a developing device containing at least a n toner and a carrier, the developing device developing a toner image on an image retainer by using the developer discharged from the developer discharge unit; wherein the first developer transport member and the second developer transport member rotate in the same axis;

the first developer transport member and the second developer transport member are overlapped in a direction of transporting the developer in the first developer-containing unit; and the second developer transport member is disposed more downstream than a downstream end portion of the first developer transport member in the first direction of the first developer transport member.

10. An image forming apparatus comprising:

a developer supply vessel containing a developer and being detachable from the image forming apparatus;

a developer discharging unit that discharges the developer to outside of the developer supply vessel;

a first developer-containing unit that contains a developer;

a first developer transport member disposed in the first developer-containing unit, the first developer transport member comprising a first transport unit having a first rotation diameter and rotating so as to transport the developer in a first direction;

a second developer transport member disposed downstream from the first developer transport member in the first direction, the second developer transport member comprising a second transport unit having a second rotation diameter that is smaller than the first rotation diameter, the second transport unit rotating so as to transport the developer in the first direction;

a developer discharge unit disposed in the first developer-containing unit, the developer discharge unit discharging the developer transported by the second developer transport member from the first developer-containing unit; and a second developer-containing unit that contains the developer discharged from the developer discharge unit;

a detector disposed in the first developer-containing unit, the detector detecting an amount of the developer at a position of the first developer-containing unit;

a controller that controls the discharging of the developer by the developer discharging unit, depending on a detection result of the detector; and a developing device containing at least a toner and a carrier, the developing device developing a toner image on an image retainer by using the developer discharged from the developer discharge unit; wherein the second developer transport member is disposed more downstream than a downstream end portion of the first developer transport member in the first direction of the first developer transport member.

11. The image forming apparatus according to claim 9, further comprising a manual paper feeder capable of being disposed inside the apparatus main body.

12. The image forming apparatus according to claim 10, further comprising a manual paper feeder capable of being disposed inside the apparatus main body.

* * * * *